US010264845B2

(12) United States Patent
Rastello

(10) Patent No.: US 10,264,845 B2
(45) Date of Patent: Apr. 23, 2019

(54) SKI BOOT SYSTEM

(71) Applicant: Kelly Rastello, Fort Collins, CO (US)

(72) Inventor: Kelly Rastello, Fort Collins, CO (US)

( * ) Notice: Subject to any disclaimer, the term of this patent is extended or adjusted under 35 U.S.C. 154(b) by 375 days.

(21) Appl. No.: 15/049,437

(22) Filed: Feb. 22, 2016

(65) Prior Publication Data

US 2016/0192729 A1 Jul. 7, 2016

Related U.S. Application Data

(63) Continuation-in-part of application No. 13/298,188, filed on Nov. 16, 2011, now Pat. No. 9,295,301.

(51) Int. Cl.

| | |
|---|---|
| ***A43B 5/04*** | (2006.01) |
| ***A43B 5/06*** | (2006.01) |
| ***A43C 11/00*** | (2006.01) |
| ***A43C 11/14*** | (2006.01) |
| ***A43C 11/12*** | (2006.01) |
| ***A43B 3/06*** | (2006.01) |
| ***A43B 23/02*** | (2006.01) |

(52) U.S. Cl.

CPC ..... *A43B 5/0476* (2013.01); *A43B 3/06* (2013.01); *A43B 5/0405* (2013.01); *A43B 5/0427* (2013.01); *A43B 23/0295* (2013.01); *A43C 11/008* (2013.01); *A43C 11/12* (2013.01); *A43C 11/142* (2013.01)

(58) Field of Classification Search

CPC ..... A43B 3/06; A43B 5/0476; A43B 5/048
USPC ..... 36/117.1, 117.3, 118.9
See application file for complete search history.

(56) References Cited

U.S. PATENT DOCUMENTS

| | | | | |
|---|---|---|---|---|
| 3,405,463 A * | 10/1968 | Werner | ..... | A43B 5/0454 36/117.6 |
| 3,530,596 A * | 9/1970 | Misteli | ..... | A43B 5/04 36/117.6 |
| 3,593,435 A | 7/1971 | Lange | | |
| 3,718,994 A | 3/1973 | Spier | | |

(Continued)

FOREIGN PATENT DOCUMENTS

| | | |
|---|---|---|
| DE | 1923818 A1 | 11/1970 |
| DE | 7022047 U | 2/1971 |

(Continued)

*Primary Examiner* — Alissa J Tompkins
*Assistant Examiner* — Cameron A Carter
(74) *Attorney, Agent, or Firm* — James A. Sheridan; Sheridan Law, LLC

(57) ABSTRACT

There is disclosed a ski boot system. One embodiment includes right and left side portions formed by a longitudinal split with a hinged connection therebetween. The open configuration allows placement of an inner liner into the shell. The closed configuration restricts removal of the liner from the shell. A selectively fastenable connector and/or a selectively locking sheath extend between the right and left side portions. The selectively fastenable connector and/or the selectively locking sheath permit selective positioning of the shell between open and closed configurations. The liner of a ski boot includes a wall of material defining inner and outer surfaces. The outer surface defines an exterior having dimensions sized to compressively fit within the shell. The inner surface defines an interior having dimensions sized to receive a foot. Other embodiments are disclosed.

15 Claims, 31 Drawing Sheets

(56) References Cited

U.S. PATENT DOCUMENTS 3,849,914 A * 11/1974 Bertele ..... A43B 5/0415 36/117.4
4,068,337 A 1/1978 Hanson et al.
4,190,970 A 3/1980 Annovi
4,255,202 A 3/1981 Swan, Jr.
4,317,296 A 3/1982 Hanson
4,599,811 A * 7/1986 Rousseau ..... A43B 3/106 36/105
4,802,290 A 2/1989 Marega
4,949,479 A 8/1990 Ottieri
4,998,358 A 3/1991 Girardelli
5,067,257 A 11/1991 Coomer
5,174,050 A * 12/1992 Gabrielli ..... A43B 5/0405 36/10
5,199,726 A * 4/1993 Willett ..... A43B 5/1641 280/11.27
5,595,006 A 1/1997 Perrissoud et al.
5,673,448 A * 10/1997 Lang ..... A43B 5/0405 12/142 P
5,893,222 A * 4/1999 Donnelly ..... A43B 5/0405 36/10
6,226,898 B1 5/2001 Trimble
6,708,425 B2 * 3/2004 Parisotto ..... A43B 5/0452 36/117.2
6,729,048 B1 5/2004 Grandin et al.
7,386,947 B2 * 6/2008 Martin ..... A43B 5/0401 36/10
7,736,208 B2 * 6/2010 Bonis ..... A63B 31/11 441/64
2002/0088146 A1 * 7/2002 Joseph ..... A43B 5/04 36/117.3
2003/0097766 A1 * 5/2003 Morgan ..... A43B 5/04 36/10
2003/0115777 A1 * 6/2003 Hall ..... A43B 3/0031 36/117.6
2004/0049950 A1 3/2004 Van Horne
2004/0074110 A1 * 4/2004 Borsoi ..... A43B 5/0405 36/50.5
2004/0107605 A1 * 6/2004 Caeran ..... A43B 3/26 36/117.1
2004/0148807 A1 8/2004 Grandin
2004/0200098 A1 * 10/2004 Martin ..... A43B 3/0047 36/114
2004/0211091 A1 * 10/2004 Heierling ..... A43B 5/04 36/117.1
2004/0244221 A1 * 12/2004 Hall ..... A43B 5/0405 36/10
2006/0064904 A1 3/2006 Confortin et al.
2006/0162192 A1 * 7/2006 Roux ..... A43B 1/0072 36/118.2
2007/0294920 A1 12/2007 Baychar
2008/0047165 A1 * 2/2008 Keen ..... A43B 3/22 36/50.1
2009/0255149 A1 10/2009 Rigat
2009/0277046 A1 11/2009 Sartor
2010/0180471 A1 7/2010 Dodge
2010/0229425 A1 * 9/2010 Parisotto ..... A43B 5/04 36/117.1
2011/0099846 A1 * 5/2011 Fischer ..... A43B 5/0433 36/117.1

FOREIGN PATENT DOCUMENTS

DE 2709134 A1 9/1977
EP 0824943 A1 2/1998
EP 1295540 B1 3/2003
EP 1527706 B1 5/2005
EP 2599399 A1 6/2013
FR 1561350 A 3/1969
GB 2474289 A 4/2011
WO 96/24266 A1 8/1996
WO 1996/023429 A1 8/1996
WO 97/26947 A1 7/1997
WO 00/51458 A1 9/2000
WO 2003/001937 A1 1/2003
WO 2006/077606 A1 7/2006
WO 2009/097550 A1 8/2009

* cited by examiner

SKI BOOT SYSTEM

This patent application is a continuation-in-part of pending prior U.S. patent application Ser. No. 13/298,188, filed Nov. 16, 2011 by Kelly Rastello for SKI BOOT SYSTEM.

The above-identified patent application is hereby incorporated herein by reference.

BACKGROUND

The basic function of a ski boot is to transmit a skier's movements to the skis. Previously, skiers wore everyday winter footwear, and though warm and comfortable, this everyday winter footwear provided little ankle support and gave the skier absolutely no control over the skis. Thick, heavy leather boots supplanted these boots. Steel shanks were installed in the leather sole to counteract buckling effects. Added rigidity was provided with long straps of leather. Porous rubber boot inserts were designed to support the ankle while providing a more conformable fit. Buckles implemented with these boots deformed the leather. Later, plastic ski boots were introduced with forward flex, lateral rigidity, and a height to permit the lower leg to help control skiing.

Custom foaming is a process in which a skier's foot is sealed into an inner boot through an injection of polyurethane foam. While custom foaming was popular with skiers, it was a constant nightmare for ski shop technicians who found the process messy, complicated, and costly since any boot foamed improperly had to be thrown away. Two years after its introduction, the process was abandoned in favor of more economical inserts.

Today's ski boots include a built-in inner lining on the inside of the shell. The lining is made of a pliable, cushioning material that provides insulation and added fit. This material can be a gel or synthetic that molds itself to the foot over extended use, or it can be a material that, when heated, provides an instantaneous custom fit.

Despite these technological advances, skiers continue to experience drawbacks relating to boot fit, boot customization, and ease of use in relation to both single and multiple users of a particular ski boot.

SUMMARY

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

One embodiment provides an outer shell of a ski boot. The outer shell includes (1) a right side portion and a left side portion formed by a longitudinal split through the outer shell of the ski boot; (2) a hinged connection between the right side portion and the left side portion, the hinged connection permitting selective positioning of the outer shell between an open configuration and a closed configuration, where the open configuration allows placement of a first liner into an interior of the shell, and the closed configuration restricts removal of the first liner from the interior of the shell; (3) a tongue rotatively coupled with the outer shell and configured to fold between an open position allowing placement of the first liner into the interior of the shell and a closed position spanning the longitudinal split and fastening the right side portion and the left side portion of the shell in the closed configuration; and (4) a selectively fastenable connector extending between the right side portion and the left side portion, the selectively fastenable connector permitting selective positioning of the outer shell between the open configuration and the closed configuration with only a hand of a user and without an additional tool.

Another embodiment provides a ski boot system. The ski boot system includes an outer shell and an inner liner, wherein the outer shell includes a right side portion and a left side portion formed by a longitudinal split through the outer shell of the ski boot and a hinged connection between the right side portion and the left side portion. The hinged connection may be disposed along a bottom portion of the longitudinally split outer shell and permit selective positioning of the outer shell between an open configuration and a closed configuration. The open configuration may allow placement of the inner liner into an interior of the outer shell, and the closed configuration may restrict removal of the inner liner from the interior of the outer shell. The outer shell may also include a locking mechanism configured to selectively retain the outer shell in the closed configuration.

Yet another embodiment provides a method of fitting a ski boot system having (1) an outer shell with a right side portion and a left side portion formed by a longitudinal split through the outer shell; (2) a hinged connection between the right and left side portions, the hinged connection configured to selectively position the outer shell between an open configuration allowing placement of an inner liner into an interior of the outer shell and a closed configuration restricting removal of the inner liner; (3) at least first and second inner liners, and (4) at least first and second inserts configured to re-contour the interior of the outer shell. The method may include rotating the hinged connection to position the outer shell in the open configuration, disposing the first insert within the interior of the outer shell, placing the first inner liner into the interior of the outer shell; and rotating the hinged connection to position the outer shell in the closed configuration.

Additional objects, advantages and novel features of the technology will be set forth in part in the description which follows, and in part will become more apparent to those skilled in the art upon examination of the following, or may be learned from practice of the technology.

BRIEF DESCRIPTION OF THE DRAWINGS

Non-limiting and non-exhaustive embodiments of the present invention, including the preferred embodiment, are described with reference to the following figures, wherein like reference numerals refer to like parts throughout the various views unless otherwise specified. Illustrative embodiments of the invention are illustrated in the drawings, in which.

DETAILED DESCRIPTION

Embodiments are described more fully below in sufficient detail to enable those skilled in the art to practice the system and method. However, embodiments may be implemented in many different forms and should not be construed as being limited to the embodiments set forth herein. The following detailed description is, therefore, not to be taken in a limiting sense.

A. Rear-Hinge Shell Design

Figure 1:
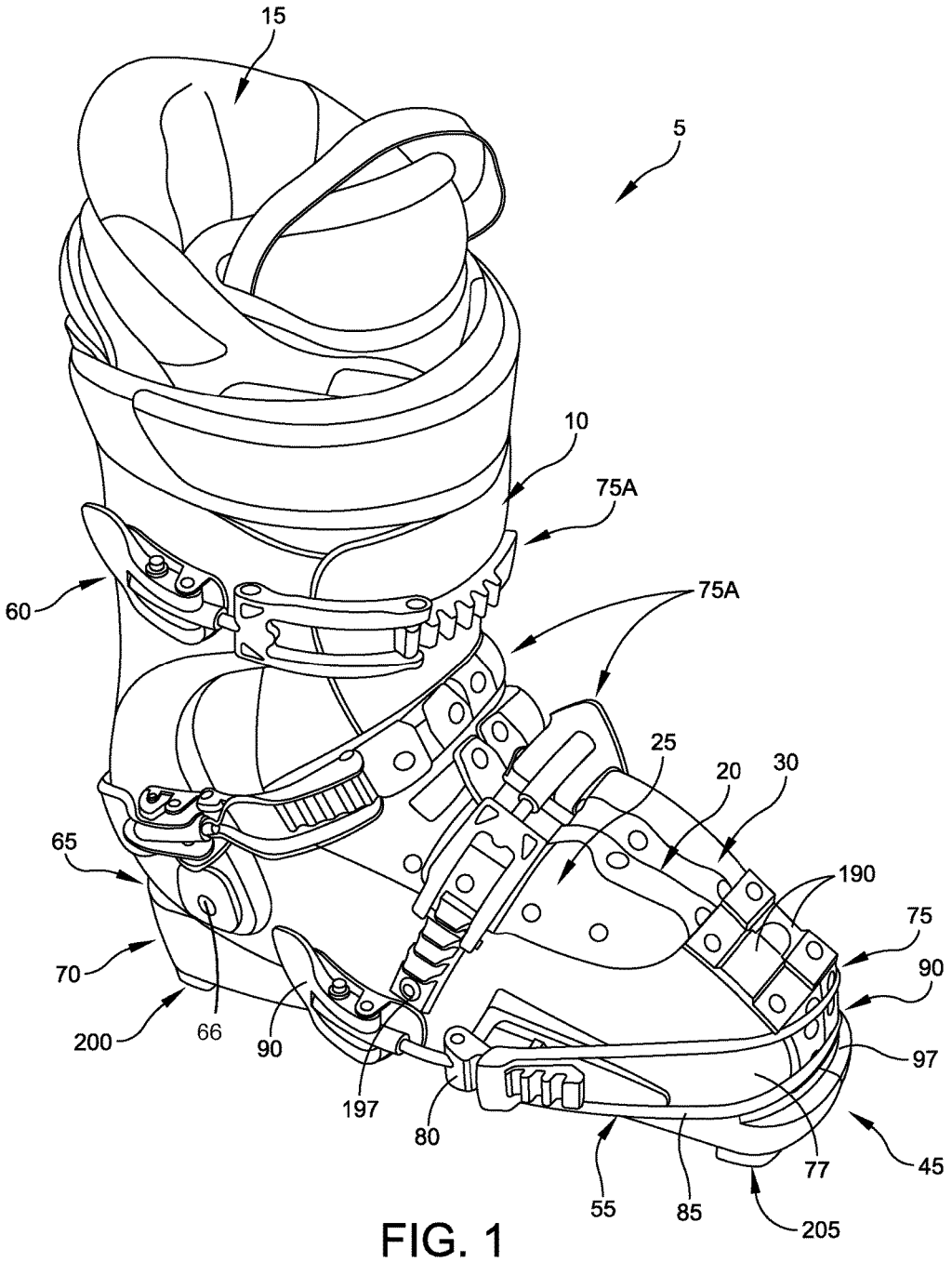
FIG. 1 illustrates a perspective view of an exemplary embodiment of a ski boot having an outer shell and a memory foam inner liner, wherein the outer shell is longitudinally split along a rear portion.
Figure 2:
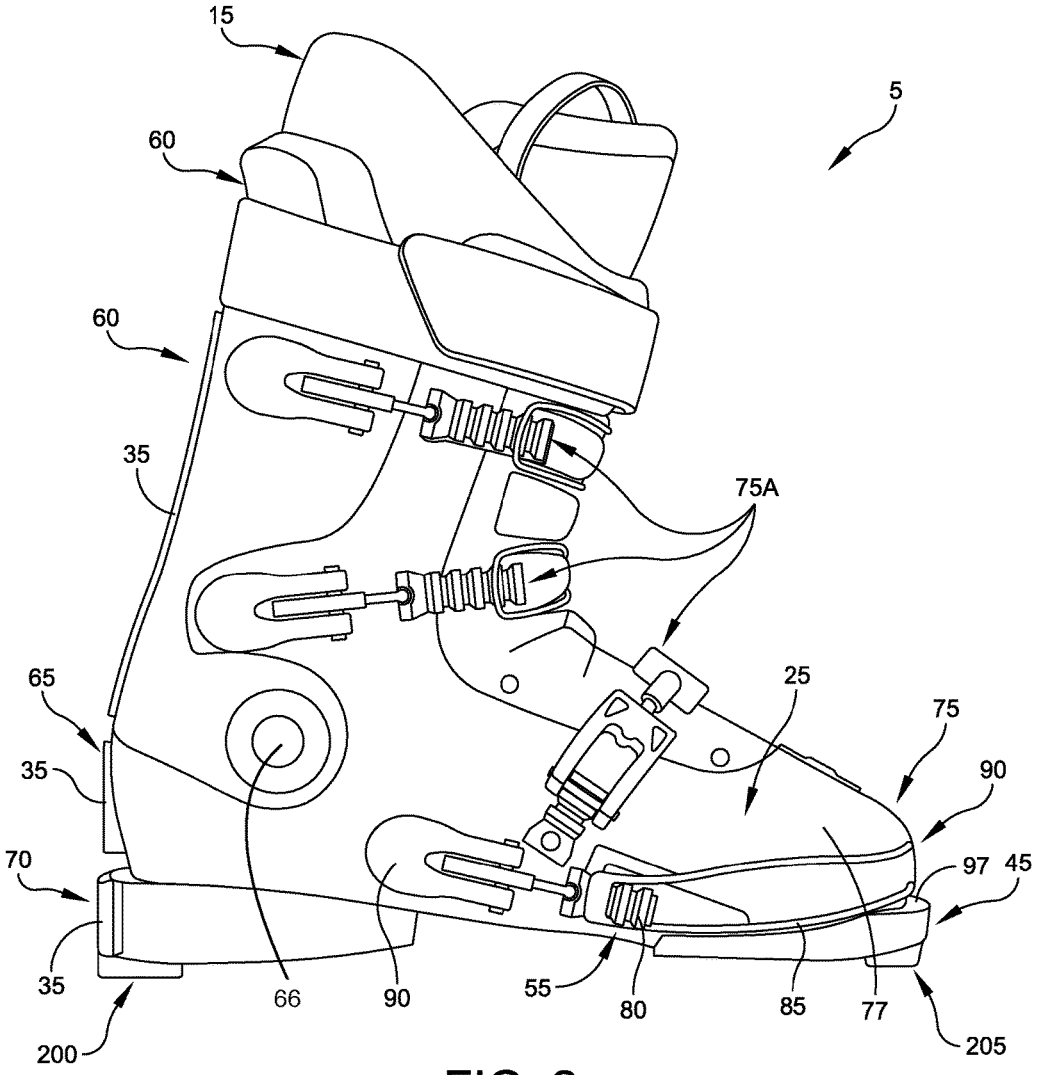
FIG. 2 illustrates a right side elevation view of the ski boot of FIG. 1.

Broadly, and with reference to FIGS. 1 and 2, an embodiment of the present invention provides a ski boot system 5. In an embodiment, there is provided an outer shell 10 and an inner liner 15. A longitudinal split 20 through the outer shell 10 may form a right side portion 25 and a left side portion 30.

Figure 3:
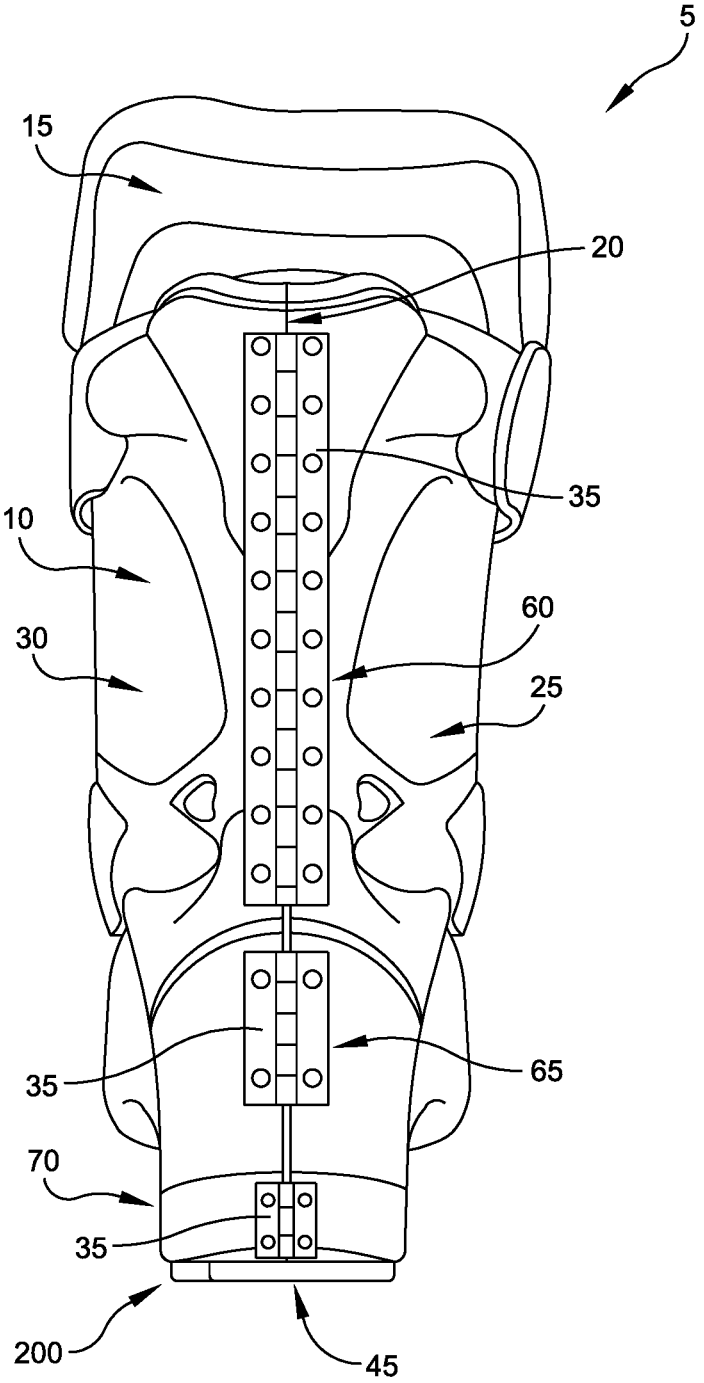
FIG. 3 illustrates a rear elevation view of the ski boot of FIG. 1.

With reference to FIG. 3, a hinged connection 35 may lie between the right side portion 25 and the left side portion 30. The hinged connection 35 may permit selective positioning of the outer shell 10 between an open configuration 40 (FIG. 4) and a closed configuration 45 (FIG. 1). The open configuration 40 (FIG. 4) allows placement of the inner liner 15 into the interior 50 of the shell 10. The closed configuration 45 restricts removal of the liner 15 from the interior 50 of the shell 10. Typically made of plastic or composite, the outer shell 10 provides stability to the boot and is primarily responsible for the transfer of energy from the body to the ski. The rigidity of the boot also provides foot and ankle protection.

With reference to FIG. 1, a selectively fastenable connector 55 may extend between the right side portion 25 and the left side portion 30. The selectively fastenable connector 55 may permit selective positioning of the outer shell 10 between the open configuration 40 and the closed configuration 45 with only a hand of a user and without an additional tool. In other words, outer shell 10 may be opened or closed by a skier, boot fitter, or other person without extensive joining or removal of hardware, and without the use of saws, glues, adhesives, bolts, and/or other time consuming and potentially damaging mechanical reconfiguration of the ski boot system. The longitudinally split sections of the boot, together with the selectively fastenable connector, or other skier operable closures, allow for ease of entry, enhanced comfort, and optimized boot fit.

In one embodiment, and with reference to FIGS. 1-4, the hinged connection 35 may include multiple separate sections. Components of the separate sections may be disposed at a rear portion of the longitudinally split shell 10. In an embodiment, the hinged connection 35 may be split into several sections and disposed on an upper cuff 60, a lower cuff 65, and a heel 70. The upper cuff of a ski boot is the portion that wraps around the calf, upper ankle and shin. It is typically connected to the lower boot by a hinge (distinct from the hinged connection 35) and is responsible for the overall stiffness, lateral stability and forward lean of the boot. As shown in FIGS. 1-2, the upper cuff 60 may be coupled with the lower cuff 65 via a rotational joint 66 (e.g., a rivet) positioned on the lower cuff 65 of each of the right side portion 25 and the left side portion 30, in line with an approximate location of a user's ankle.

Figure 4:
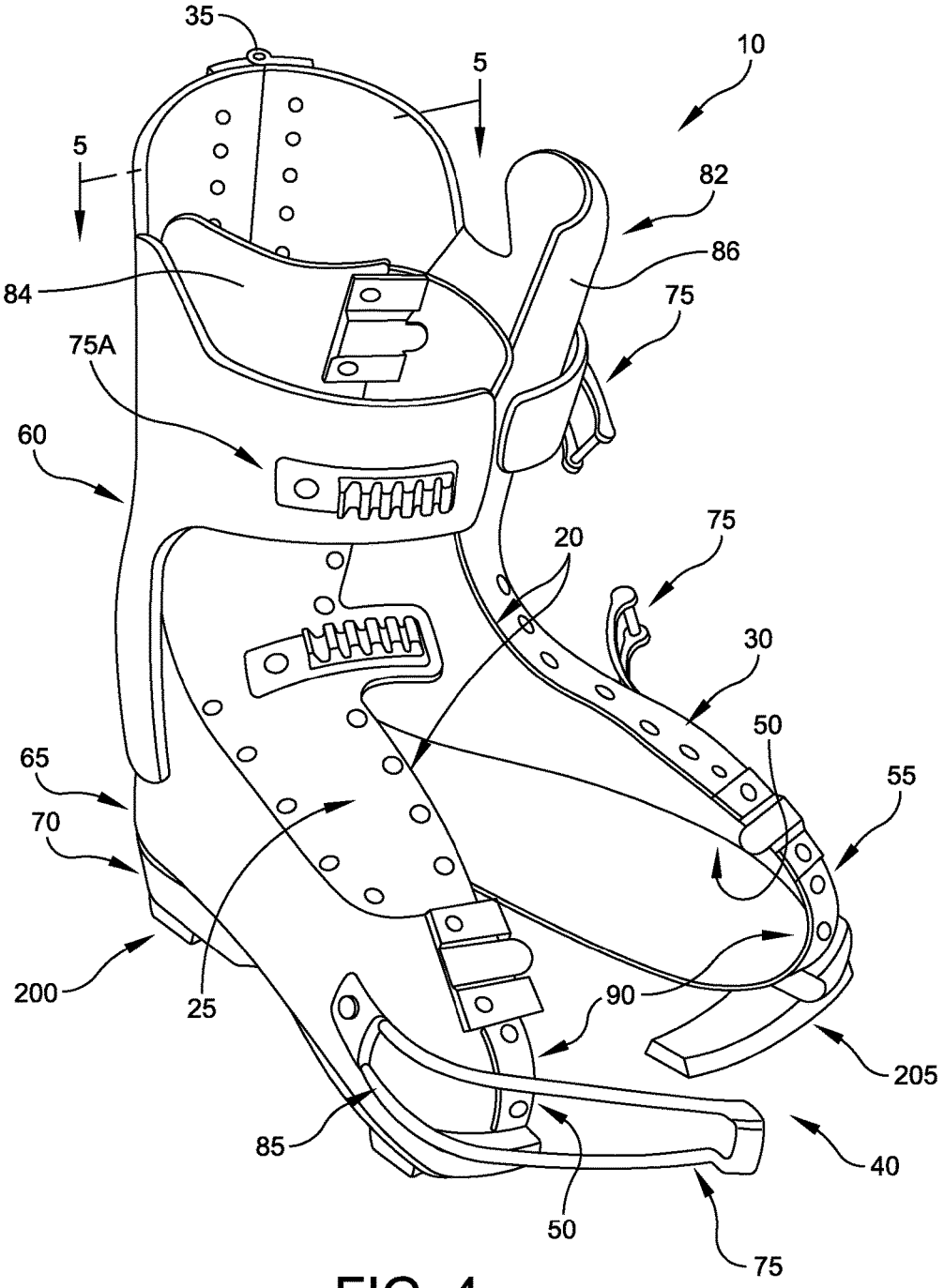
FIG. 4 illustrates a perspective view of the outer shell of the ski boot of FIG. 1 in an open configuration.
Figure 20:
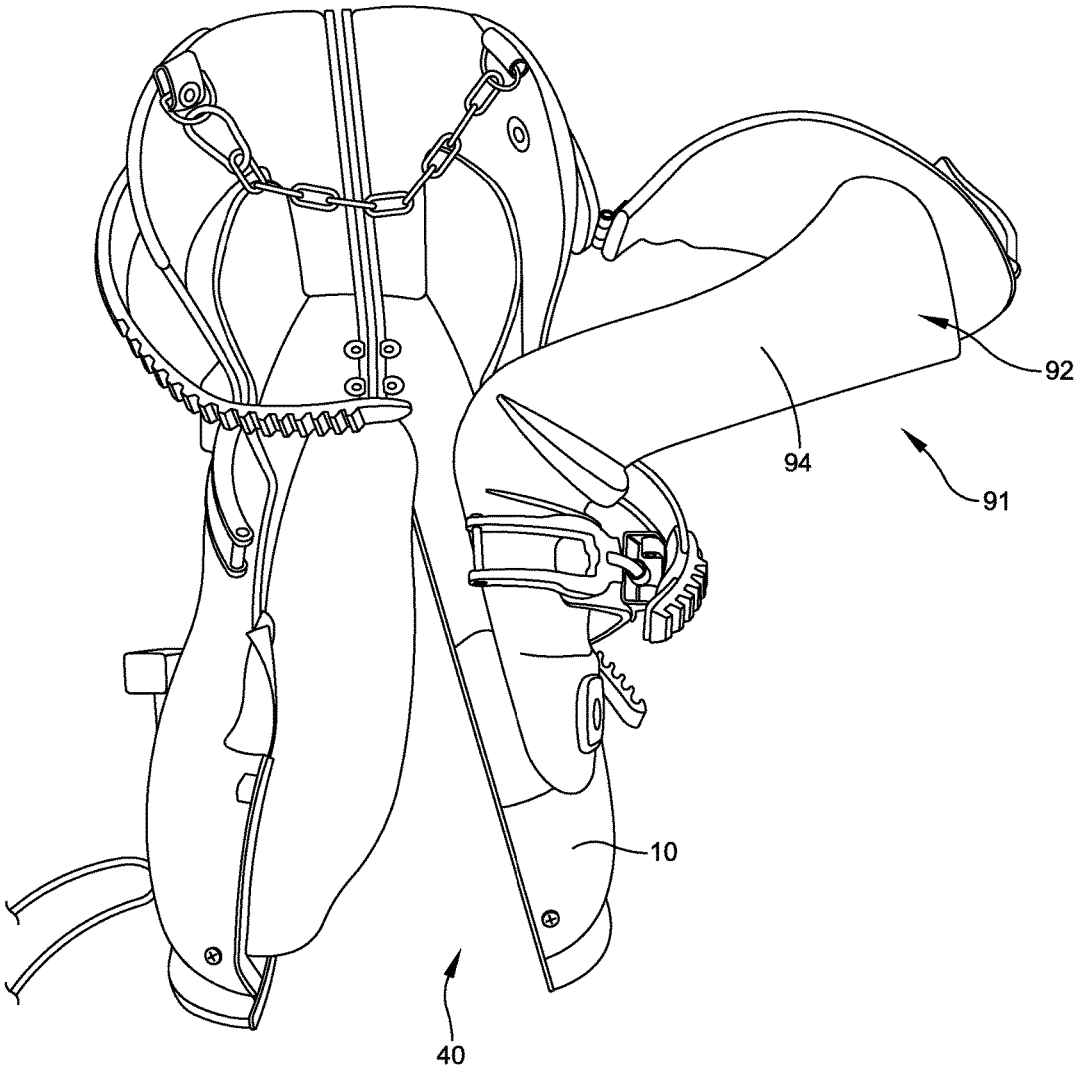
FIG. 20 illustrates a front perspective view of another embodiment of an outer shell for a ski boot having a longitudinal split along a rear portion, positioned in an open configuration, and having a single-piece tongue rotated to an open position.

FIG. 4 illustrates an embodiment in which the shell 10 may include a two-piece tongue 82 that splits along the longitudinal split 20 of the shell 10 into a right tongue portion 84 and a left tongue portion 86. In another embodiment shown in FIGS. 20-22, the shell 10 may include a single-piece tongue 92 formed from a solid panel 94. The single-piece tongue may be rotatively connected to the outer shell 10. As shown in FIG. 20, this rotative connection allows the single-piece tongue 92 to be rotated or folded aside into an open position 91 when shell 10 is positioned in the open configuration 40, thereby allowing the skier to easily position his or her foot and ankle within the shell 10. When the shell 10 is moved into the closed configuration 45, shown in FIG. 21, the single-piece tongue 92 may be rotated upright into a closed position 93 and secured in place against the skier's foot and shin using buckles 75A, discussed below.

The single-piece tongue may be connected to the shell 10 in any appropriate manner that allows for proper folding or rotating of the tongue 92 both outward and inward for access and retention, respectively. In one embodiment, shown in FIG. 22, the single-piece tongue 92 may be attached to the left-side portion 30 of the shell 10 using one or more hinged fasteners 96.

Figure 21:
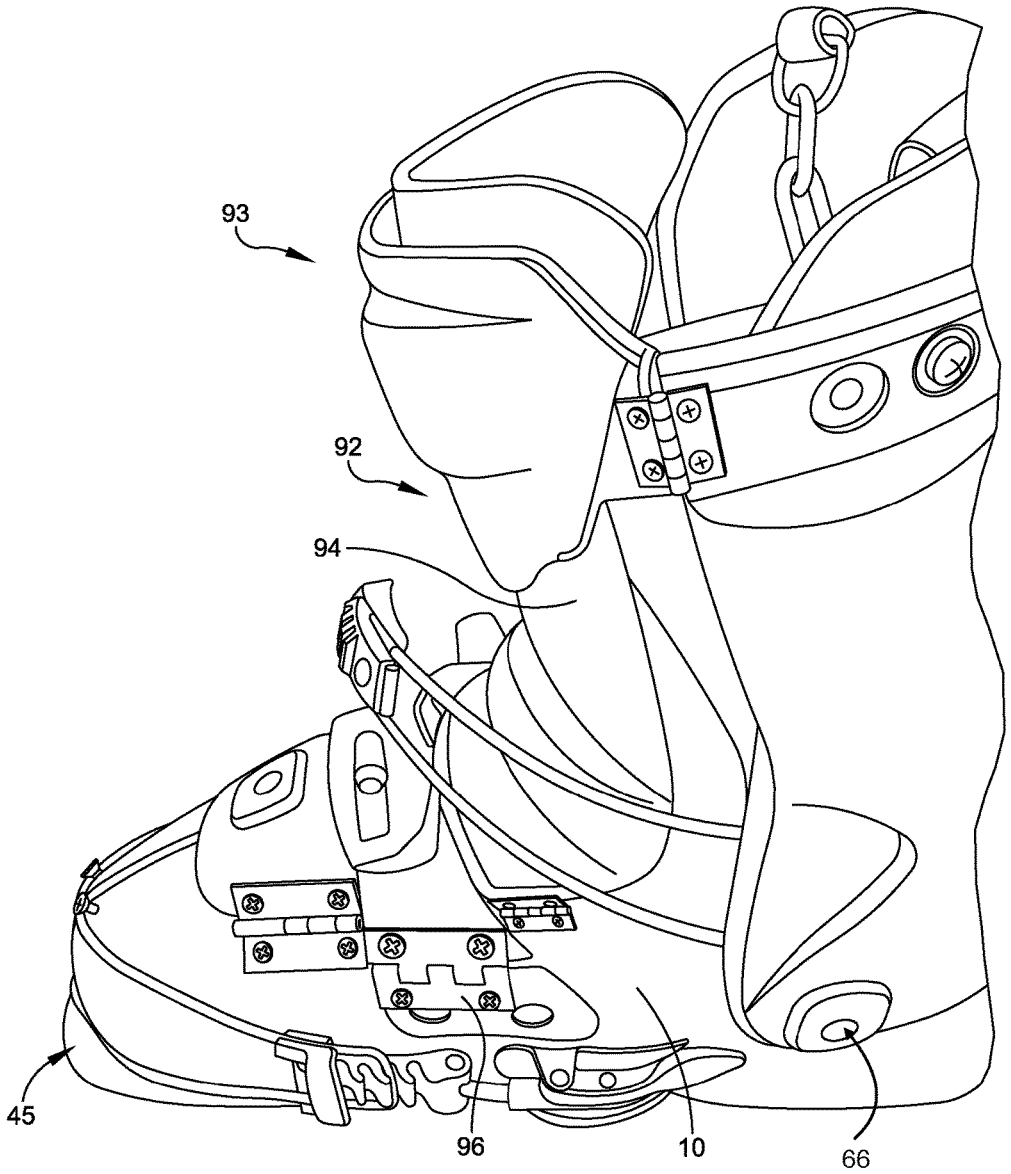
FIG. 21 illustrates a partial left side view of the outer shell of FIG. 20 with the single-piece tongue rotated to a closed position.
Figure 22:
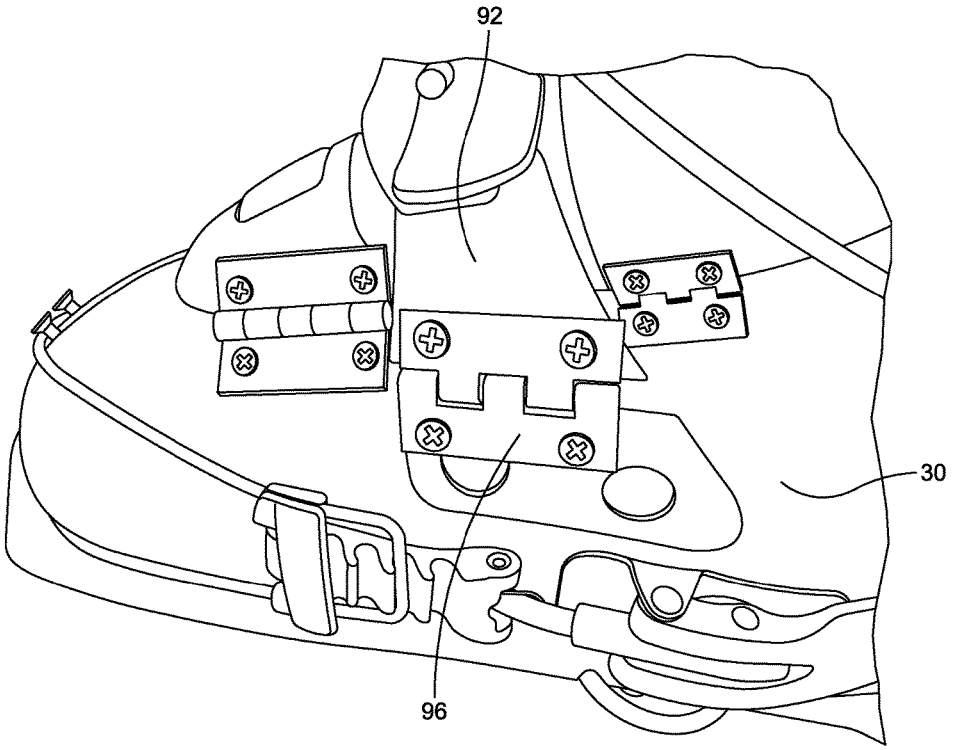
FIG. 22 illustrates a partial left side view of the outer shell of FIGS. 20-21, detailing one embodiment of a set of hinges configured to attach the single-piece tongue to the outer shell of FIGS. 20-21.

Both the split tongue 82 (FIG. 4) and the single-piece tongue 92 (FIGS. 20-22) have advantages. The split tongue 82 provides a simpler design having fewer moving parts, which results in a streamlined manufacturing process, assembly, and ultimately, use. The single-piece tongue 92 may overlap with the right and left side portions 25, 30 of the shell 10 when in the closed position 93 (FIG. 21). As a result, the longitudinal split 20 through the outer shell 10 is not exposed to elements such as wind, snow, and extreme cold when the boot is in use, ensuring that the skier's foot, ankle, and shin remain protected from low temperatures, moisture, and other elements.

Returning to FIG. 1, the selectively fastenable connector 55 may be disposed at a front (or toe) portion 77 of the longitudinally split shell 10. In an embodiment, the selectively fastenable connector 55 is a buckle system 75 having a ladder 80, bail 85, and latch arm 90. A recessed portion 97 may be provided at the front (or toe) portion 77 and the recessed portion 97 may be configured to receive the bail 85 of the selectively fastenable connector 55. This recessed portion 97 may include notched out sections of the shell 10 in order to hold the cable or bail 85 of the connector 55 just above the front lug of the shell 10. This lug is the portion that clicks into a ski binding. Blending the cable into the shell prevents any adverse effects on the operation of the boot and binding interface. However, there is usually a gap between the boot and the binding so as to allow the cable or bail 85 to remain slightly exposed from the surface of shell 10.

Figure 23:
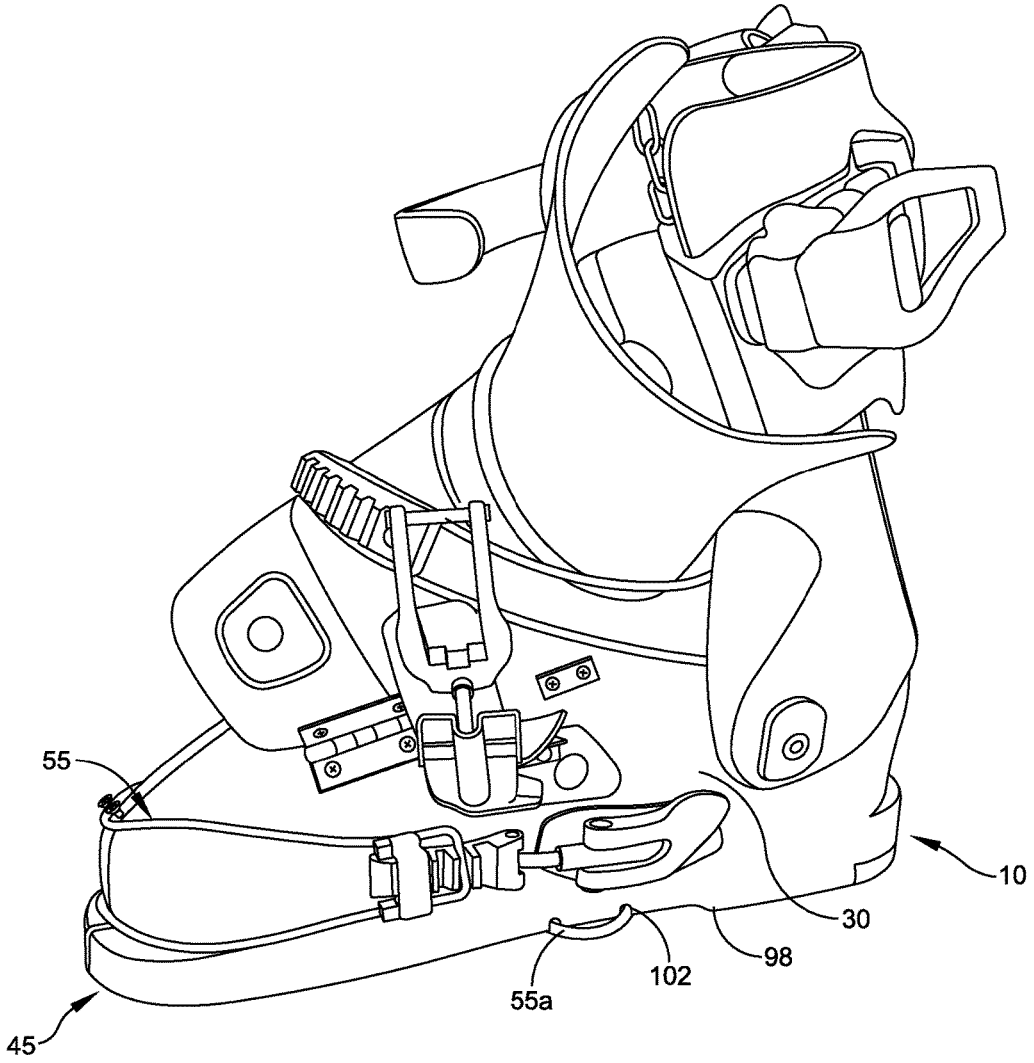
FIG. 23 illustrates a left perspective view of the ski boot shell of FIGS. 20-21 having a selectively fastenable connector spanning a bottom portion of the shell.
Figure 24:
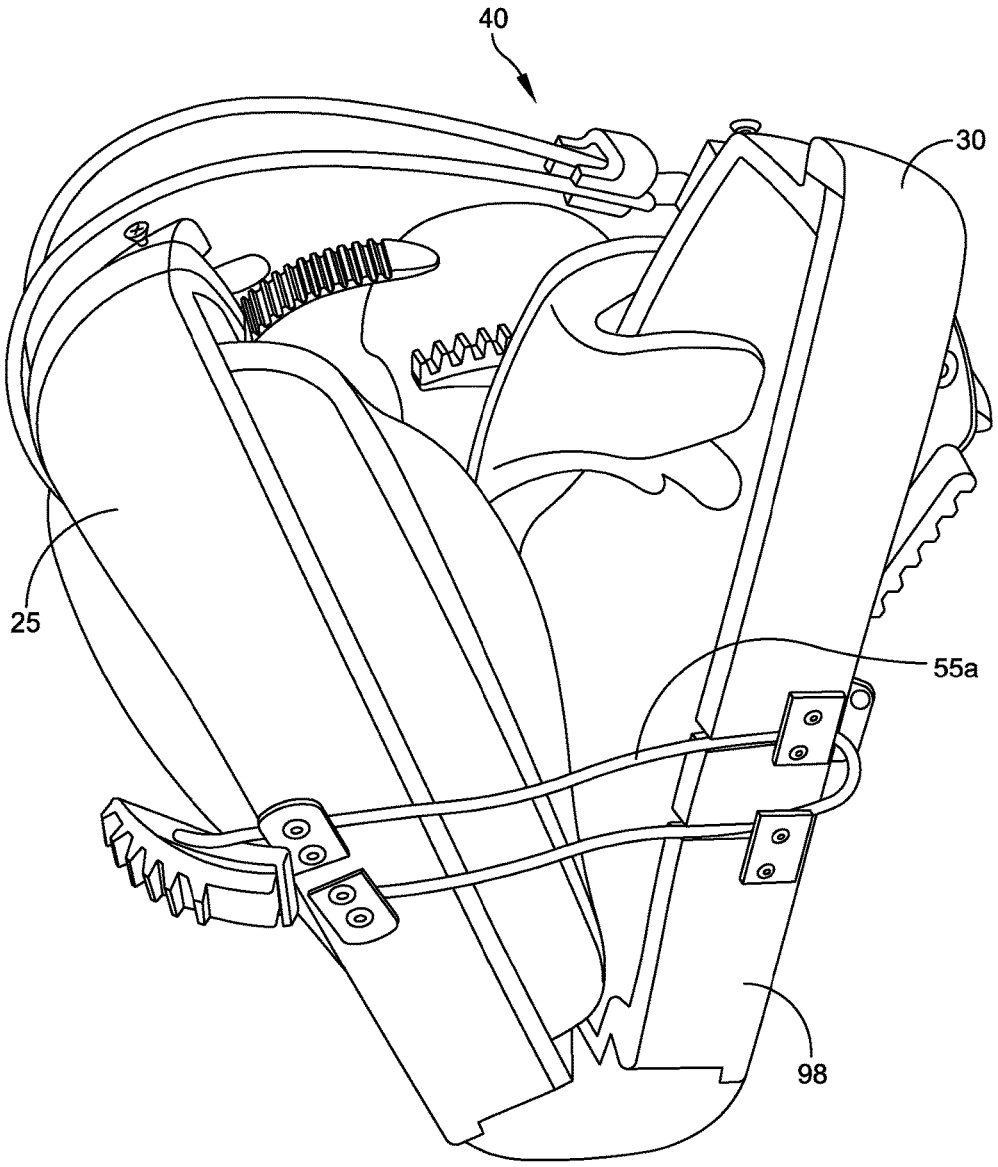
FIG. 24 illustrates a bottom perspective view of the outer shell and the selectively fastenable connector of FIG. 23, where the outer shell is positioned in an open configuration.
Figure 25:
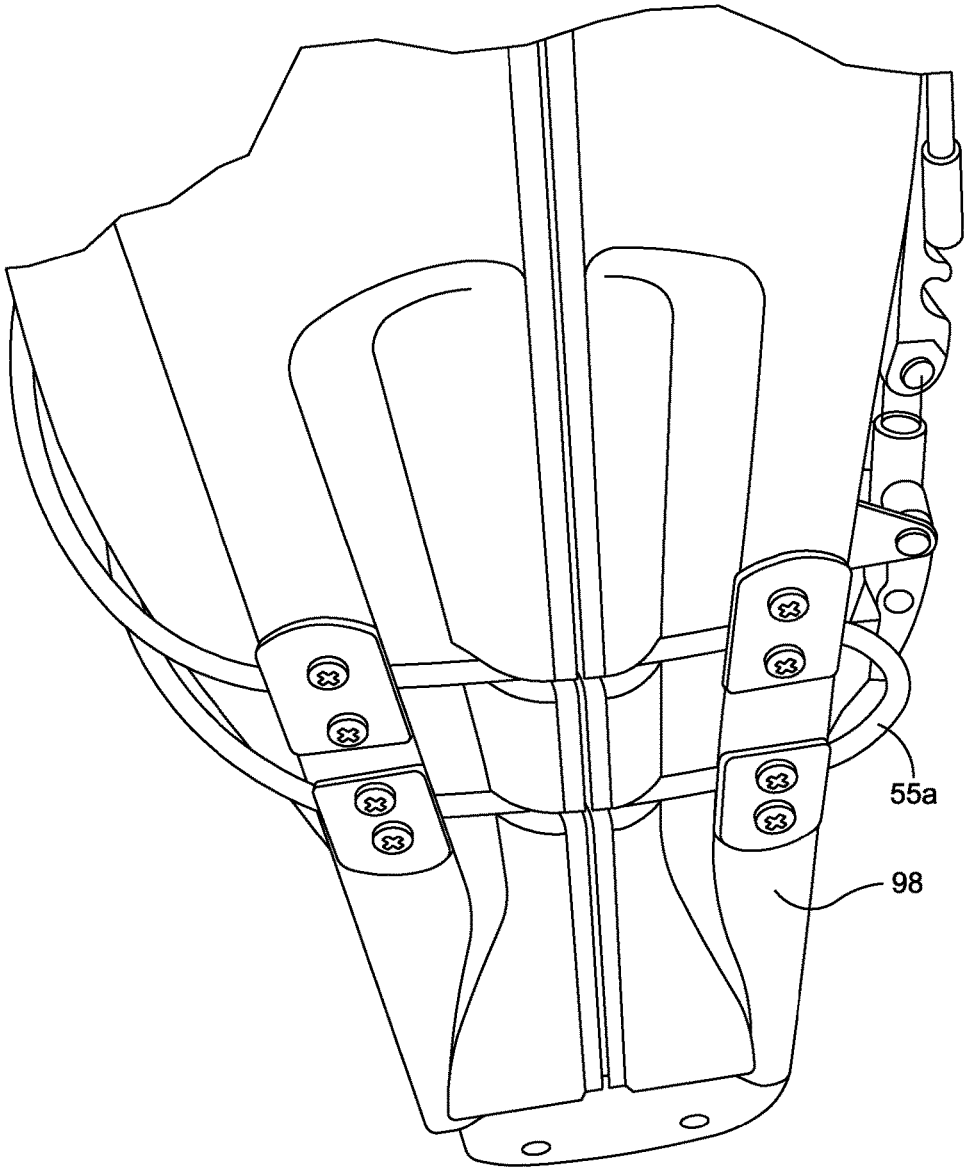
FIG. 25 illustrates a partial bottom perspective view of the shell and selectively fastenable connector of FIGS. 23-24, where the outer shell is in a closed configuration.

While FIG. 1 depicts the selectively fastenable connector 55 connected across the front portion 77 of the split shell 10, another selectively fastenable connector 55*a*, shown in FIGS. 23-25, may span or wrap beneath a bottom portion 98 of the shell 10, either in place of or in addition to selectively fastenable connector 55 located at the toe end or front portion 77 of the shell 10. FIGS. 23-25 detail one embodiment of selectively fastenable connector 55*a*. In this embodiment, connector 55*a* may be formed from a cable buckle that spans the bottom portion 98 of the shell between the right side portion 25 and the left side portion 30 of the shell 10. The cable buckle may be a commercially available connector that fits within clearance channels or grooves 102 provided in the bottom portion 98 of the shell 10. The built in selectively fastenable connector 55*a* allows for more secure retention of the right side and left side portions 25, 30 of the shell in the closed configuration 45 (FIG. 23). It is also closer to the skier's center and, therefore, within easier reach for the skier, making it easier for the skier to move the shell 10 between the open and closed configurations 40, 45.

As shown in FIG. 1, buckle system 75 may be in addition to or supplemented by other buckles 75A that latch to close the shell 10. In addition to the buckles identified herein, many styles of buckles or fasteners may be used to close various portions of the shell 10. In an embodiment, buckle systems generally may include the ladder 80, the bail 85, and the latch arm 90 (which may be referred to as the buckle itself). The ladder 80 is the graduated rung that the bail 85, or wire, hooks onto so that the buckle latch arm 90 can close so as to latch the boot tightly around the foot or ankle. Ski boots may have as many as four buckles, each drawing the boot tightly around a different segment of the foot or ankle.

Figure 5:
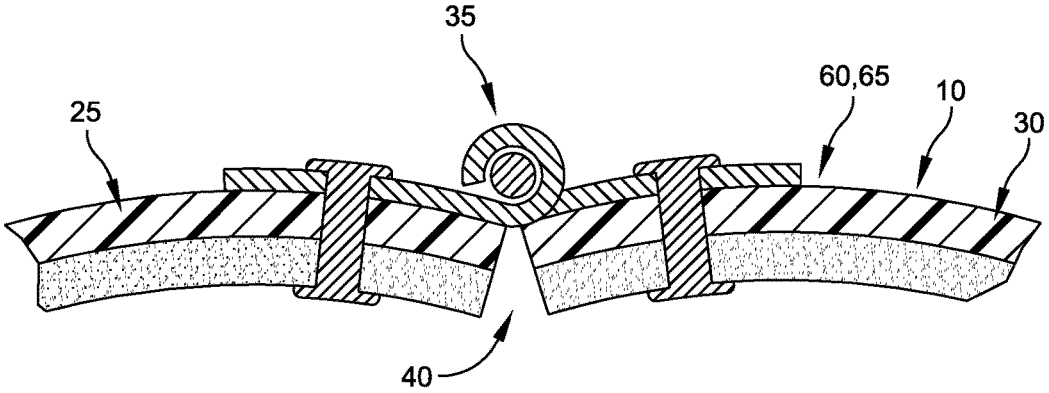
FIGS. 5 and 6 illustrate cross-sectional views of an embodiment of a hinged connection of the outer shell of FIG. 4.
Figure 6:
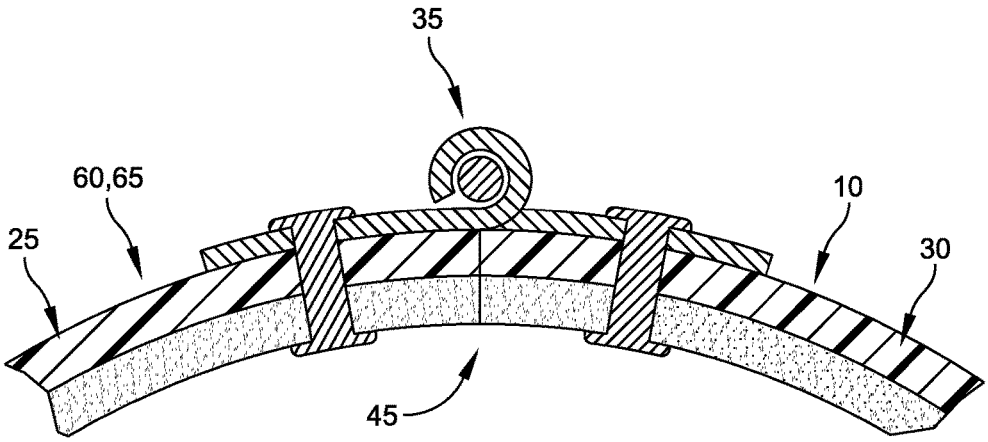

FIGS. 5 and 6 illustrate cross-sectional views of embodiments of the hinged connection 35 between the right side portion 25 and the left side portion 30 of shell 10. In FIG. 5, the hinged connection 35 is shown in the open configuration 40. In FIG. 6, the hinged connection 35 is shown in the closed configuration 45. In this embodiment, hinged connection may be disposed in a position protruding away from the outer shell 10 at the upper cuff 60 and the lower cuff 65. In various embodiments, the hinged connection 35 may be configured to maintain the right side portion 25 and the left side portion 30 in pivotal attachment with one another.

Figure 5A:
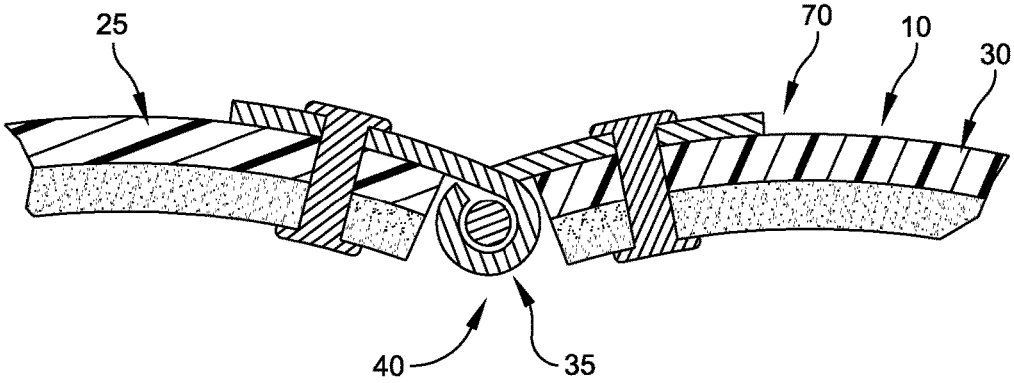
FIGS. 5A and 6A illustrate cross-sectional views of another embodiment of a hinged connection of the outer shell of FIG. 4.
Figure 6A:
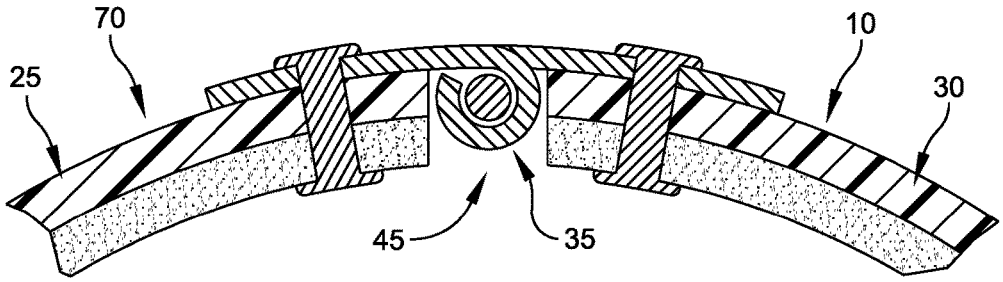
Figure 7:
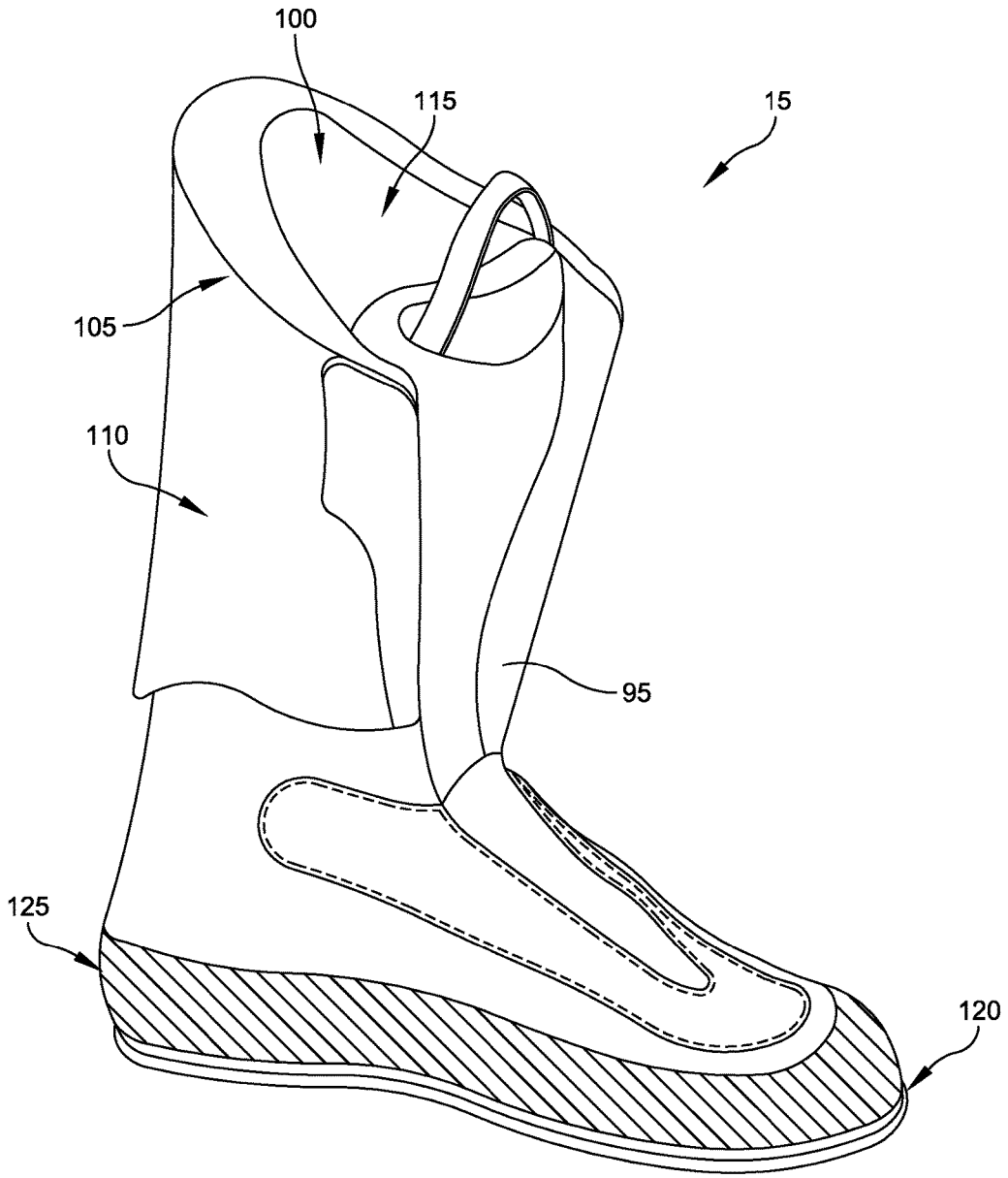
FIG. 7 illustrates a perspective view of the inner liner of the ski boot of FIG. 1.
Figure 8:
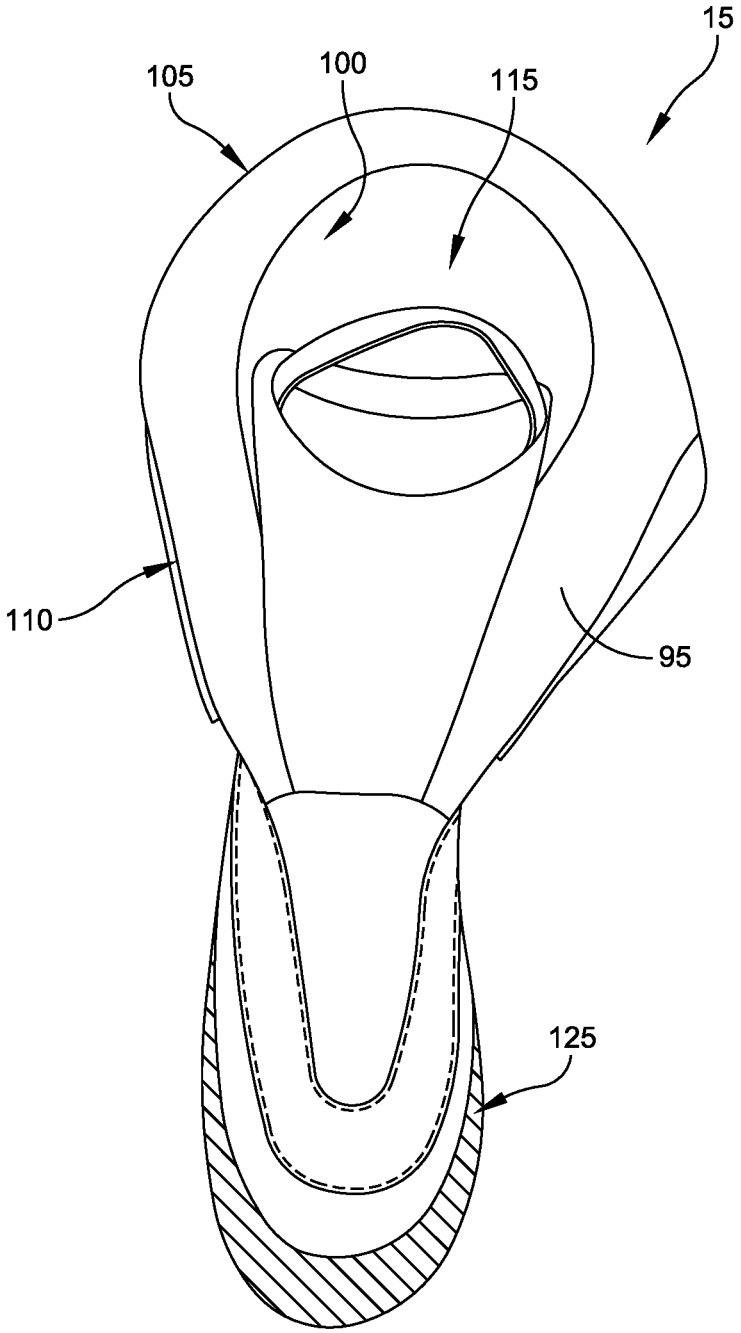
FIG. 8 illustrates a top perspective view of the inner liner of FIG. 7.
Figure 9:
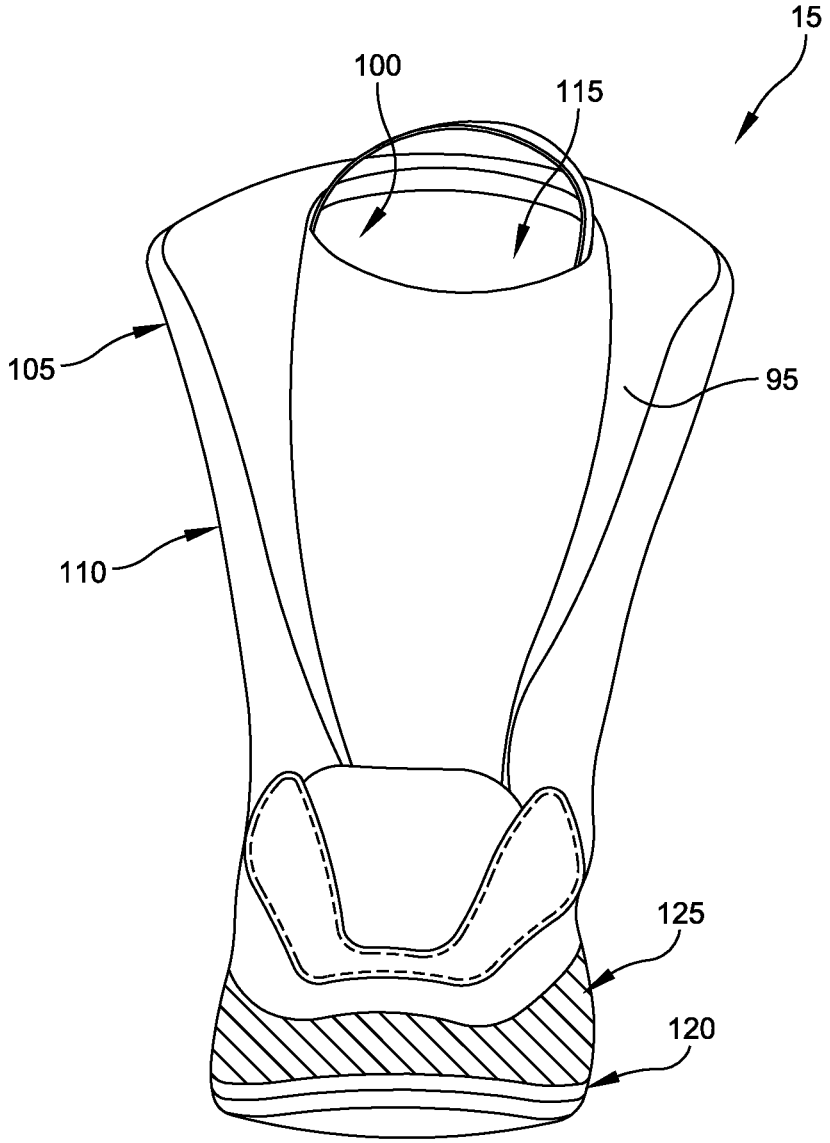
FIG. 9 illustrates a front perspective view of the inner liner of FIG. 7.
Figure 10:
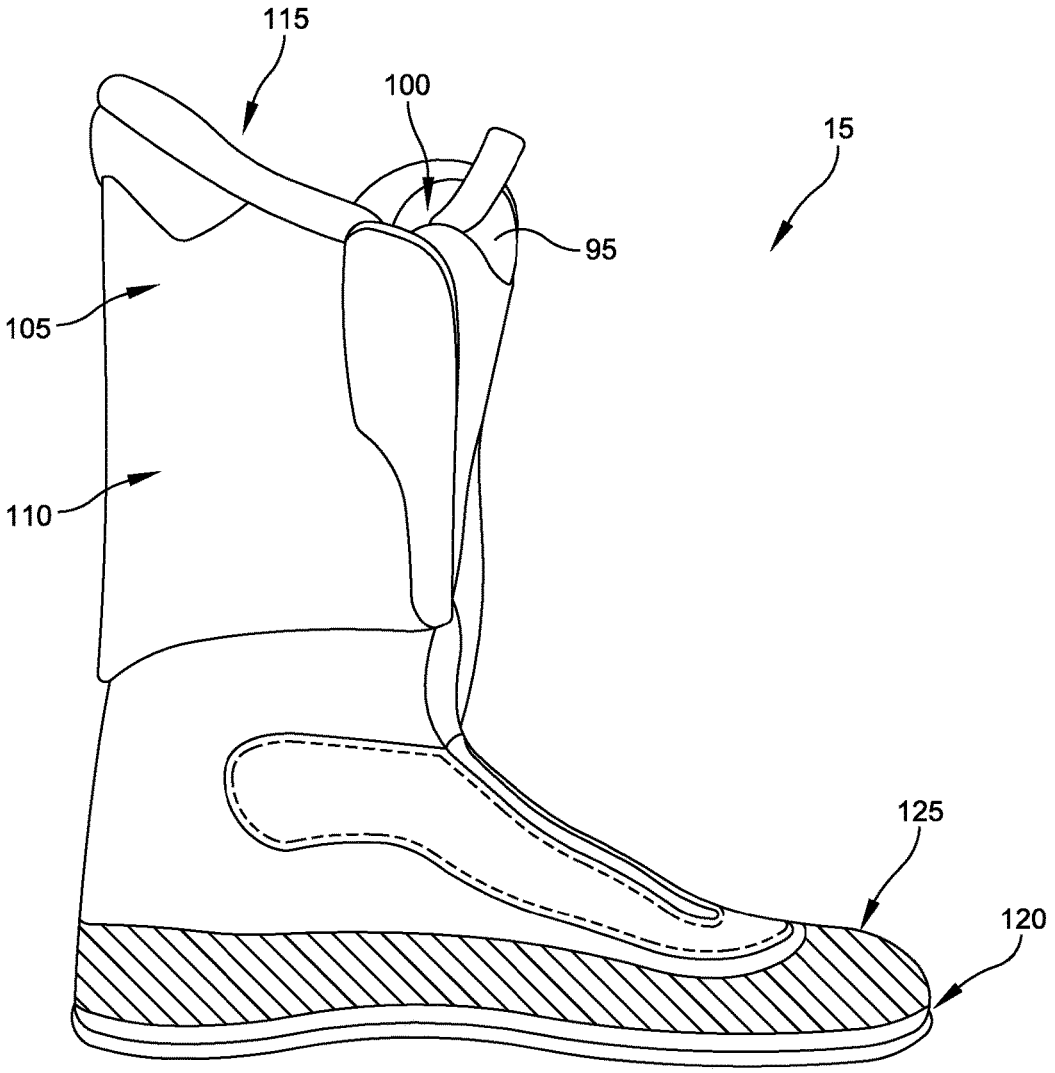
FIG. 10 illustrates a right side view of the inner liner of FIG. 7.

FIGS. 5A and 6A illustrate cross-sectional views of alternate embodiments of the hinged connection 35 between the right side portion 25 and the left side portion 30. In FIG. 5A, the hinged connection 35 is shown in the open configuration 40. In FIG. 6A, the hinged connection 35 is shown in the closed configuration 45. In this embodiment, hinged connection 35 may be disposed in a position protruding toward the outer shell 10 at the heel 70.

In one embodiment, and with reference to FIGS. 3 and 4, shell 10 may include a replaceable heel component 200 and a replaceable toe component 205. The replaceable heel component 200 and the replaceable toe component 205 may be replaceably attached to one of the right side portion 25 and the left side portion 30 and simply slide into its position with respect to the other portion. In other embodiments, these components may attach in various manners to one or both of the right side portion 25 and the left side portion 30.

In another embodiment, the hinged portion and the selectively fastenable connector may be repositioned with respect to one another so as to selectively open and close the ski boot with respect to the longitudinally split opening. The longitudinally split sections of the boot, together with the selectively fastenable connector, or other skier operable closures, allow for ease of entry, enhanced comfort, and optimized boot fit.

In other embodiments, the hinged connection may be placed on the bottom or sole together with buckles on the front and back of the shell. The two longitudinally split halves of the shell may be connected by magnets, buckles, or other combinations of selectively operable fasteners.

Generally, in one embodiment, a rubber gasket may be provided on the front portion of the longitudinal split 20, or various portions of the longitudinal split, in order to prevent snow, water, and other material from entering into the interior 50 of shell 10. Overlapping or interlocking portions of the right side portion 25 and the left side portion 30 may be provided on the bottom of the shell 10 in order to prevent leaking into the liner. In addition, this overlapping configuration may provide rigidity in order to prevent unwanted flex of the outer shell 10 during skiing.

Figure 19:
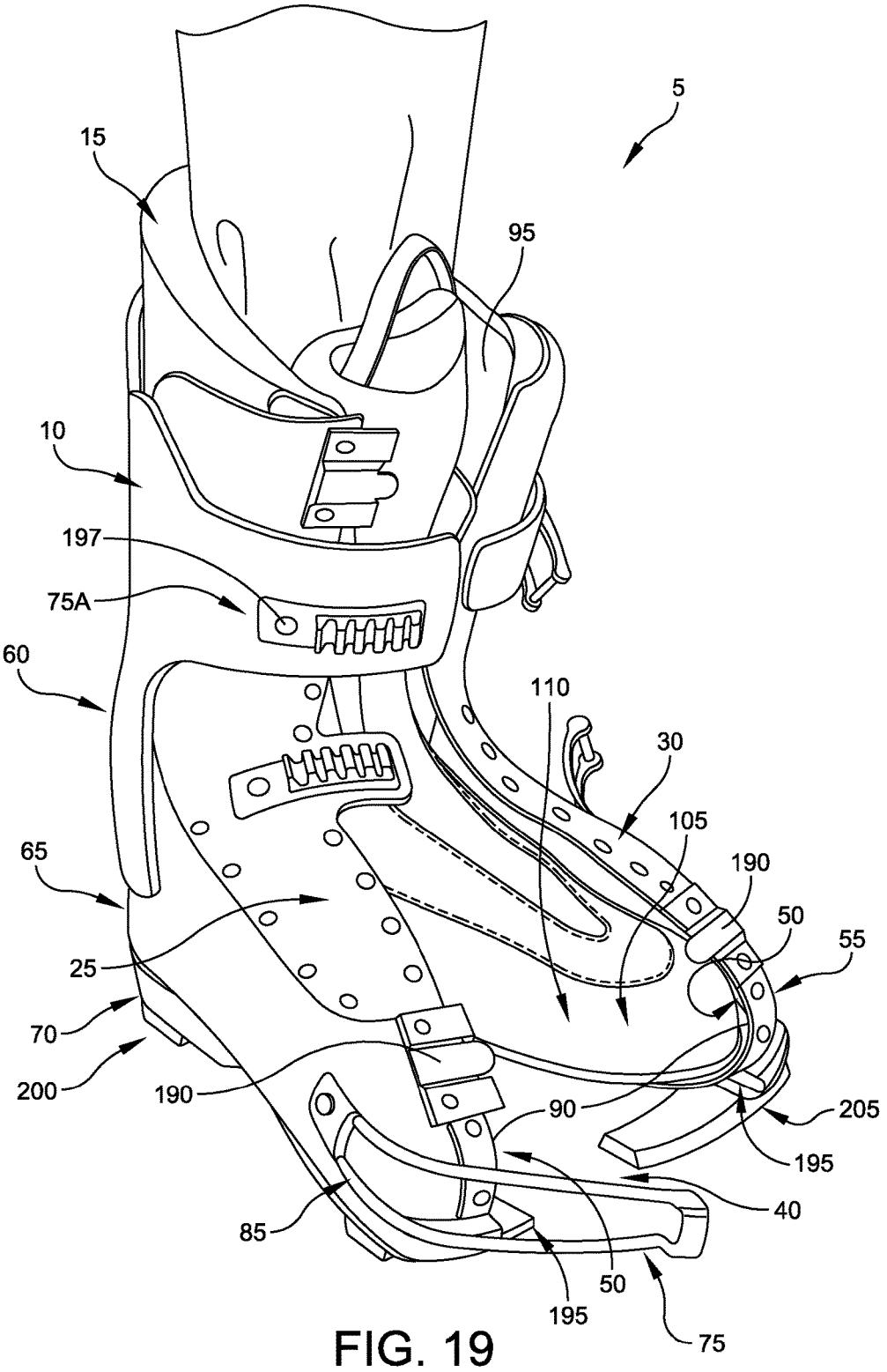
FIG. 19 illustrates a perspective view of the ski boot of FIG. 1 in an open configuration to allow removal of the inner liner of FIGS. 7-10.

Referring to FIGS. 1 and 19, and in one embodiment, interlocking reinforcements 190 may be provided adjacent to longitudinal split 20. As illustrated, these interlocking reinforcements 190 are discrete components added to the shell 10. This prevents the two longitudinal halves of the shell from overlapping with one another. This also prevents the portions of the shell 10 from sliding across each other as the skier makes a turning motion or other rotational twist of the foot. These reinforcements may be made of metal or other suitable material. In other embodiments, these reinforcements may be integral or otherwise formed into the right side portion 25 and the left side portion 30.

In an embodiment, and with reference to FIG. 19, there may be provided a riveted hinge attachment 197 pivotally attaching one or more of the buckle systems 75 to the outer shell 10. The riveted hinge attachment 197 allows movement of the buckle system 75, 75A away from the longitudinal split to allow for easier insertion and removal of the skier's foot inside of the inner liner 15. In FIG. 19, there is also shown an interlocking boot board 195, which provides added rigidity and reinforcement as described above.

B. Bottom-Hinge Shell Design

Figure 26:
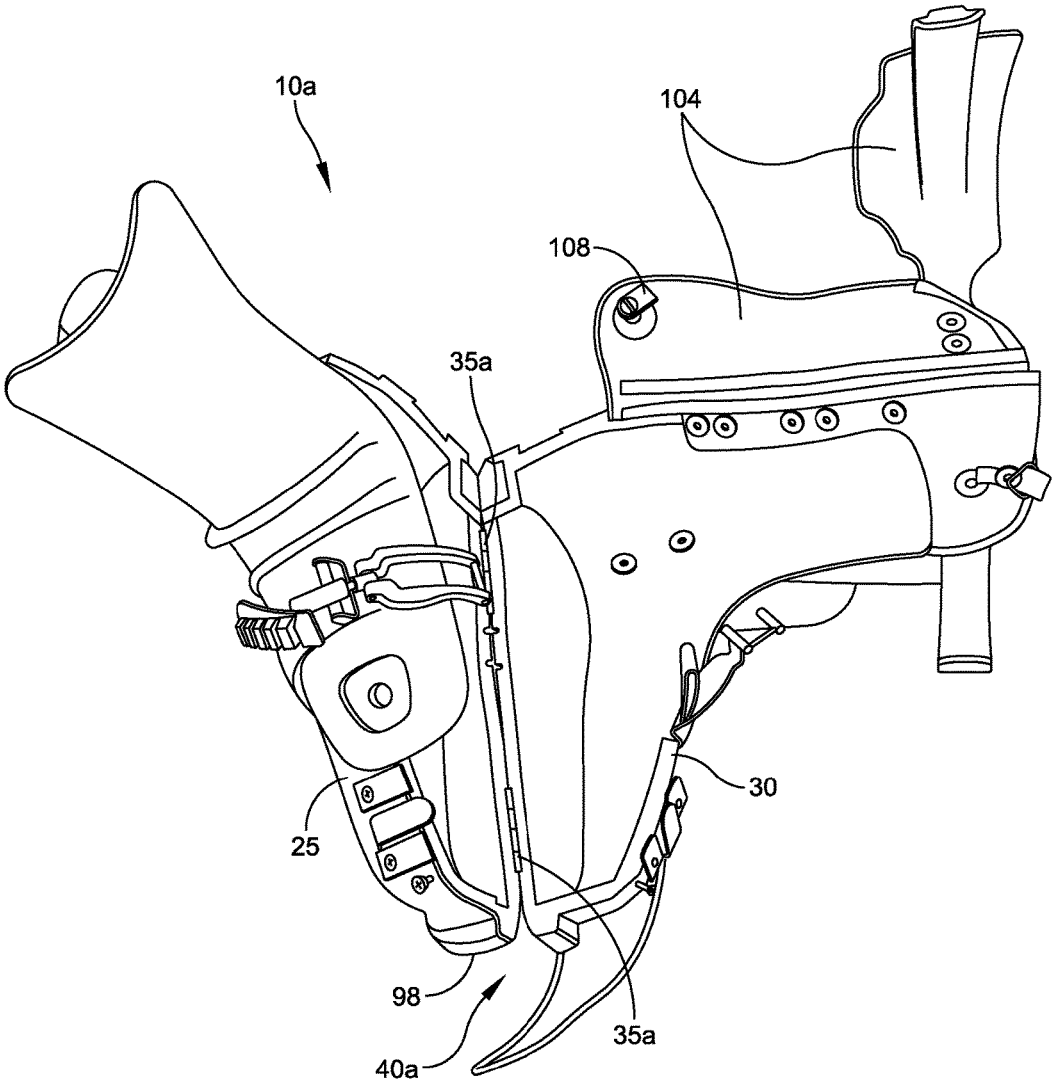
FIG. 26 illustrates a perspective view of another exemplary embodiment of an outer shell for a ski boot positioned in an open configuration, where the outer shell is longitudinally split along a bottom portion.
Figure 27:
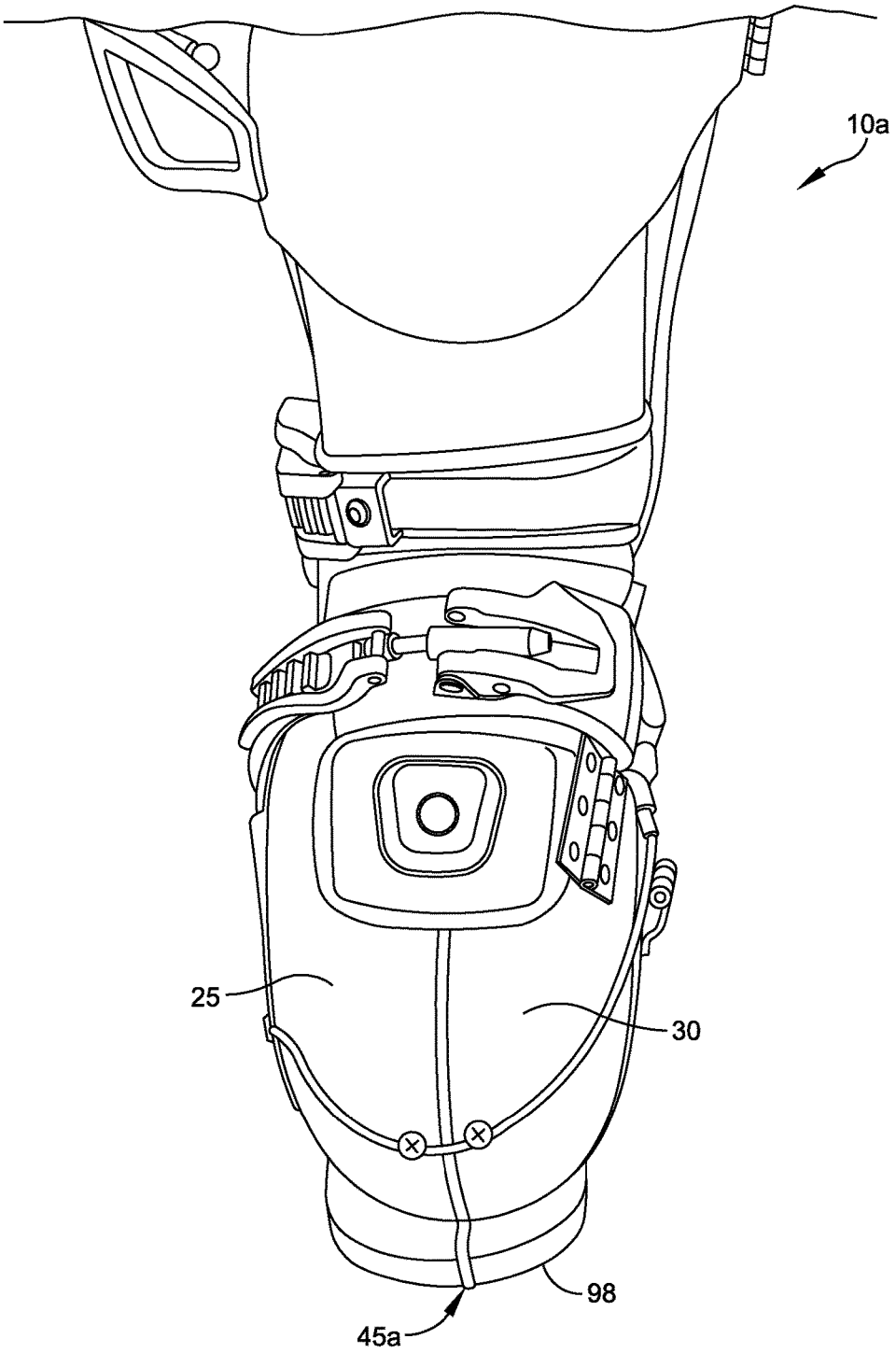
FIG. 27 illustrates a partial front perspective view of the shell of FIG. 26 in a closed configuration.

FIGS. 26-27 illustrate another embodiment of an outer shell 10*a*, which largely parallels the outer shell 10, discussed above, with two primary differences. In this embodiment, the outer shell 10*a* features a hinged connection 35*a* between the right side portion 25 and the left side portion 30 of the shell 10*a*. The hinged connection 35*a* may permit selective positioning of the outer shell 10*a* between an open configuration 40*a* (FIG. 26) and a closed configuration 45*a* (FIG. 27). In this embodiment, the hinged connection 35*a* may include multiple separate sections that join the right side portion 25 and the left side portion 30 of shell 10*a* along the bottom portion 98 of shell 10*a*, rather than along the rear portion, as discussed above in relation to shell 10.

Hinged connection 35*a* allows for a number of easy-engagement, yet secure, locking mechanisms to be incorporated into shell 10*a*. FIGS. 28-33 detail various embodiments of these locking mechanisms. In one embodiment, shell 10*a* includes a sheath 104 (FIG. 26) that wraps from the left side portion 30 to the right side portion 25 of shell 10*a*, where it may releasably attach to shell 10*a*.

Figure 28:
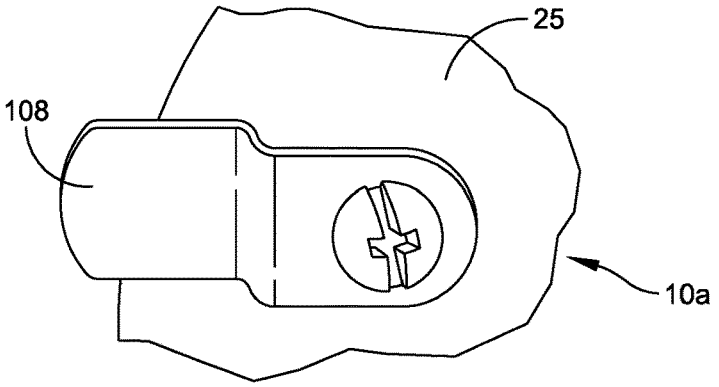
FIG. 28 illustrates a top view of one embodiment of a toggle for a toggle locking mechanism for selectively locking the ski boot shell of FIGS. 26-27 into the closed configuration.
Figure 29:
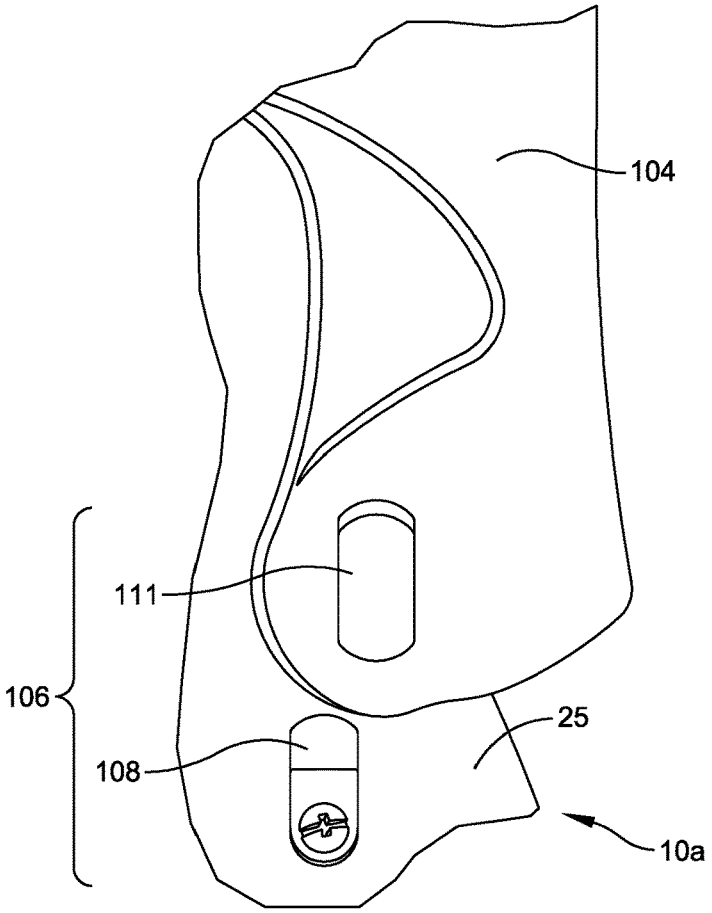
FIG. 29 illustrates a perspective view of one embodiment of a sheath forming an aperture configured to receive and retain the toggle of FIG. 28.
Figure 30:
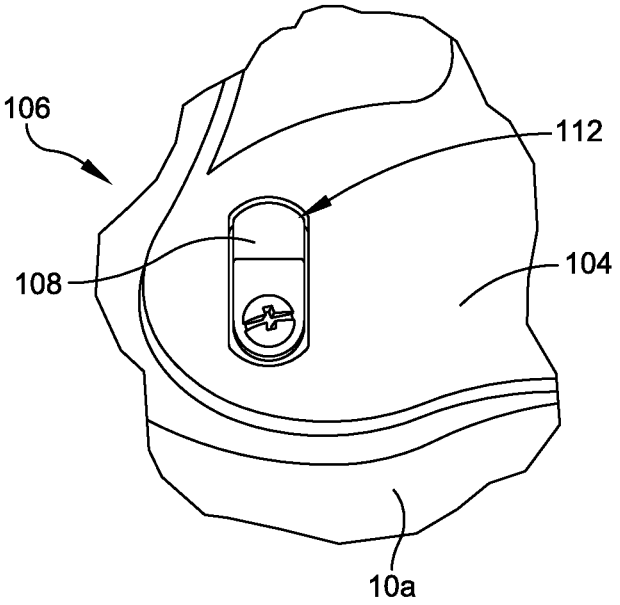
FIG. 30 illustrates a perspective view of the toggle locking mechanism of FIGS. 28-29 in an unlocked position.
Figure 31:
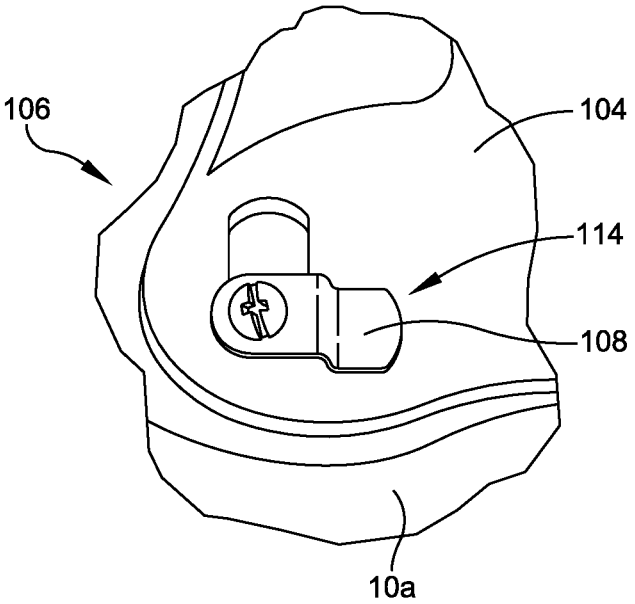
FIG. 31 illustrates a perspective view of the toggle locking mechanism of FIGS. 28-29 in a locked position.

FIGS. 28-31 detail the functionality of a toggle locking system 106 for securing the sheath 104 to the shell 10*a*. In this embodiment, and as shown in FIG. 28, a manual toggle 108 may be disposed upon the right side portion 25 of the shell 10*a*. A corresponding aperture 111 may be located on the sheath 104, as shown in FIG. 29, such that when the sheath 104 is wrapped from the left side portion 30 to the right side portion 25 of the shell 10*a*, the aperture 111 aligns with the toggle 108, which is configured to move between an unlocked position 112 and a locked position 114, shown in FIGS. 30-31, respectively. To secure the toggle locking mechanism 106, the skier may simply slip the toggle 108 disposed upon the shell 10*a* through the aperture 111 within sheath 104 and rotate the toggle from the unlocked position 112 (FIG. 30) to the locked position 114 (FIG. 31). This motion may be accomplished through the use of any appropriate manual actuating device, such as, for example, a key, a button, or a lever attached to the back side of the toggle 108. Alternatively, a user may directly rotate toggle 108 with his or her fingers.

While FIGS. 28-31 depict the toggle 108 as disposed upon the shell 10*a* and the aperture 111 formed within the sheath 104, the location of the toggle 108 and the aperture 111 may be reversed in other embodiments. That is, the toggle 108 may be disposed upon the sheath 104, as shown in FIG. 26, and configured to engage with a corresponding aperture formed within the shell 10*a* (not shown). Moreover, the toggle 108 and the corresponding aperture 111 may take any appropriate size, shape, and/or configuration as to allow for efficient interplay between the between the toggle 108 and the aperture 111. The sheath 104 may be formed of any appropriate material such as, for example, plastic or composite, with sufficient flexibility and strength to wrap around the shell 10*a* and reliably secure the right and left side portions 25, 30 together in the closed configuration 45*a* (FIG. 27).

Figure 32:
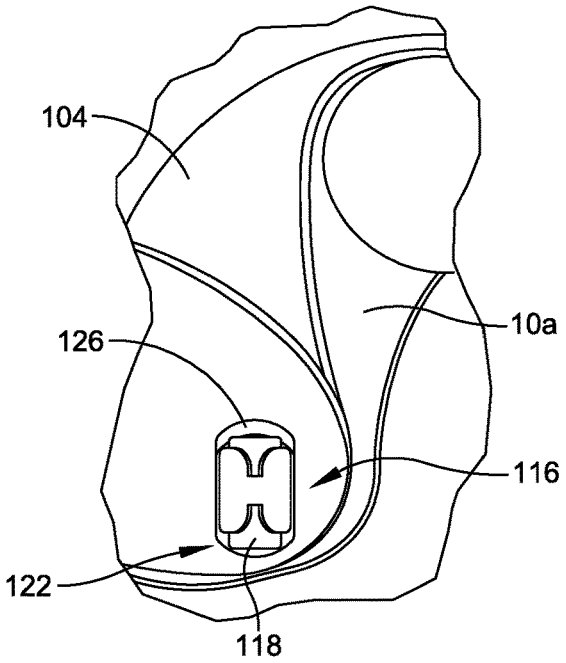
FIG. 32 illustrates a perspective view of a sliding locking mechanism for selectively locking the ski boot shell of FIGS. 26-27 in an unlocked position.
Figure 33:
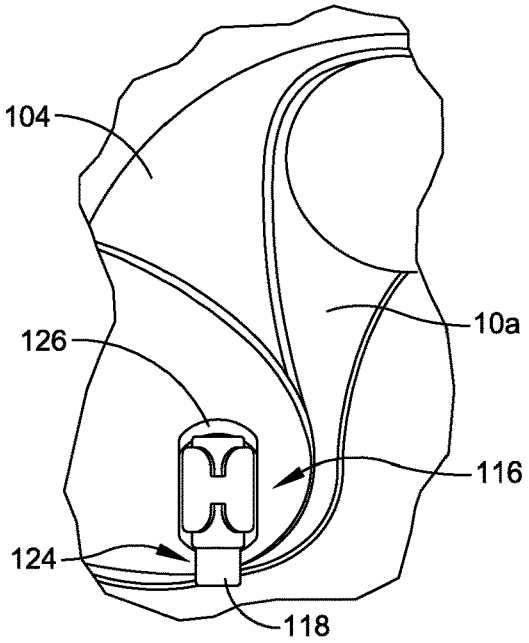
FIG. 33 illustrates a perspective view of the sliding locking mechanism of FIG. 32 in a locked position.

FIGS. 32-33 illustrate another embodiment of a locking mechanism for the shell 10*a* and the sheath 104. In this embodiment, the locking mechanism may be a slider locking mechanism 116, in which the toggle 108 is replaced with a manually actuated slider 118 that moves between a retracted, unlocked position 122 (FIG. 32) and an extended, locked position 124 (FIG. 33) with a sliding or "switchblade" type motion. The slider 118 may be disposed upon the shell 10*a* in a manner configured to align with an aperture 126 formed within the sheath 104 when the sheath 104 is wrapped around the right and left side portions 25, 30 of the shell 10*a*. To secure the slider locking mechanism 116, the skier may slip the slider 118 through the aperture 126 and move the slider from the retracted, unlocked position 122 (FIG. 32) to the extended, locked position (FIG. 33) such that the slider 118 presses directly against (i.e., creates interference with) the sheath 104, thereby preventing movement or disengagement of the sheath 104 and outer shell 10*a* in the closed configuration 45*a* (FIG. 27).

C. Liner

FIGS. 7-18 illustrate various views of one embodiment of the inner liner 15, which provides both comfort and protection while increasing the skier's performance. The padding of the inner liner 15 cushions the foot and ankle, protects it from friction, impact and cold as well as creating full foot contact, which forms the foundation for energy to transfer from the body to the ski. Ski performance is directly related to how well the foot contacts the inner liner of the boot and how well the inner liner integrates with the outer shell.

With reference to FIGS. 7-10, and in an embodiment, a wall of material 95 defines an inner surface 100 and an outer surface 105 of the inner liner 15. The outer surface 105 defines an exterior 110 having dimensions sized to compressively fit within the outer shell 10, 10*a*. The inner surface 100 defines an interior 115 having dimensions sized to receive a foot of a skier. A shape memory foam may form at least a portion of the wall of material 95. The shape memory foam may be configured to conform to the shape of the foot of the skier and this allows for a customized fit to the wearer's foot upon each use. The memory foam is less dense and more moldable than currently utilized carpet foam, which is not moldable to the user's foot in the same fashion as memory foam. Carpet foam becomes depressed over time and usually does not exceed a quarter-inch thickness. Memory foam does not get compressed over time to a shape, but will expand back to its regular shape after the foot is removed from the liner 15. The dimensions of the interior 100 are formed with the shape memory foam smaller than the foot and too uncomfortable to allow compressive insertion of the foot when the inner liner 15 is disposed within the outer shell 10.

Current custom liners are rigid and hard for performance. With the liner 15 including shaped memory form, as long as the foot is securely wrapped, the heel is locked into place within the liner 15, there is high performance achieved with even the use of softer foam. Without the longitudinal split 20, it would be difficult to slide the foot into the liner 15 within the boot. Otherwise, a much thinner layer of memory foam would need to be implemented and it would to provide the surrounding support to the user's foot. In various embodiments, the thickness of the memory foam around the ankle is about 1.5 to 2 inches. Around the rest of the heal wrap, it is about 1 to 1.5 inches.

In an embodiment, the outer surface 105 may include a sole 120 so as to allow use of the inner liner 15 as a snow boot apart from the outer shell 10, 10*a*. Extending upwardly from the sole 120, the outer surface 105 may include a rubber covering 125. This covering may extend upwardly from the sole about 1-2 inches, or more.

Figure 11:
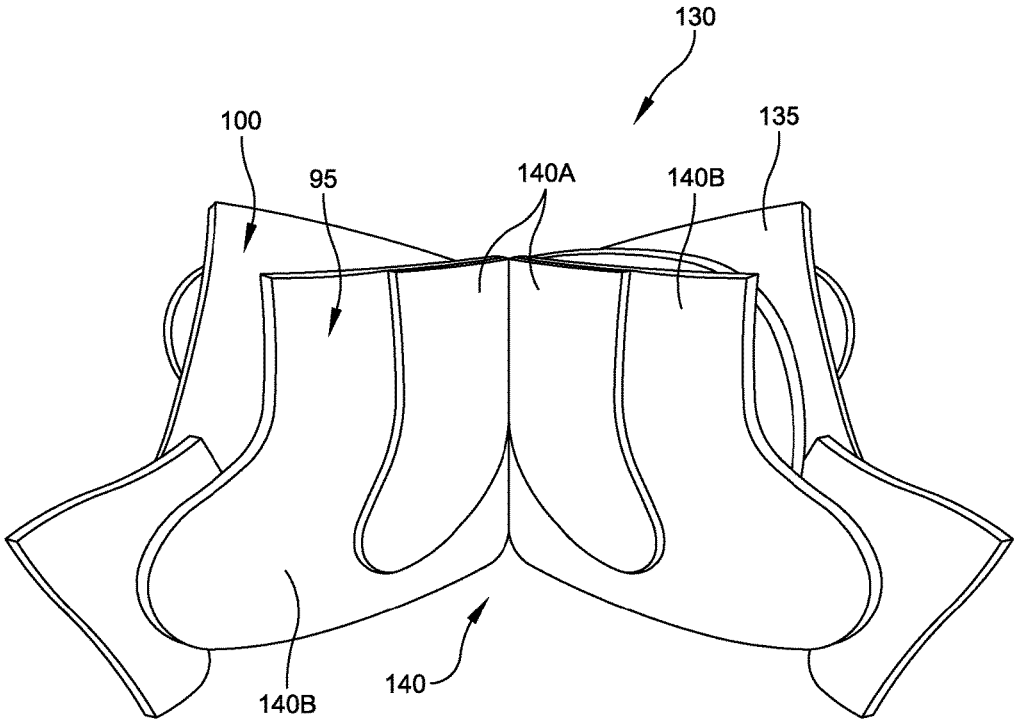
FIG. 11 illustrates a front perspective view of a heel portion of the inner liner of FIGS. 7-10.
Figure 12:
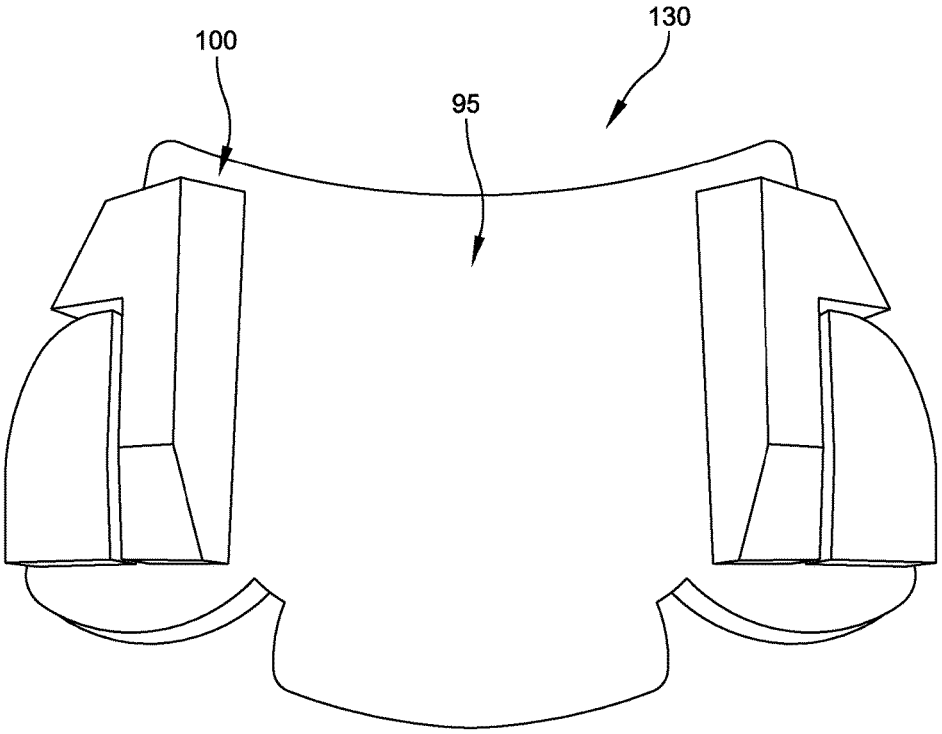
FIG. 12 illustrates a rear perspective view of the heel portion of the inner liner of FIGS. 7-10.
Figure 13:
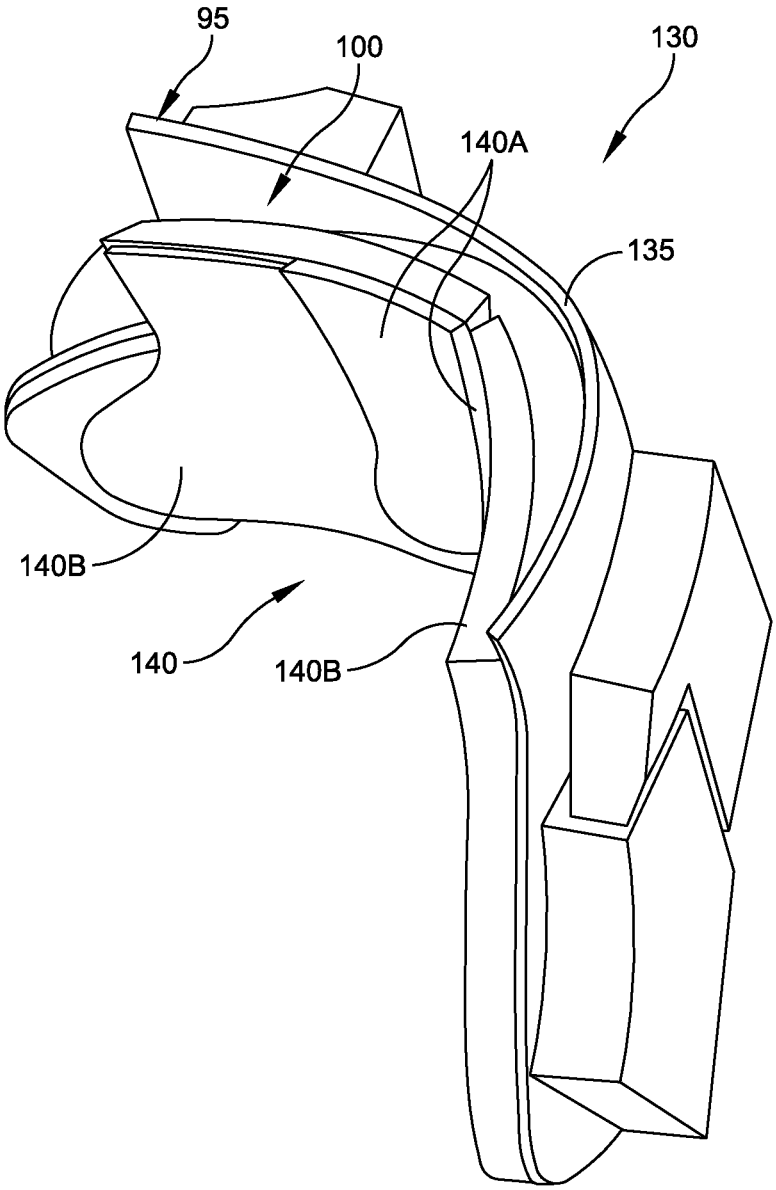
FIG. 13 illustrates a top perspective view of the heel portion of the inner liner of FIGS. 7-10.

FIGS. 11-13 illustrate a heel reinforcement section 130 of the inner liner 15. The heel and ankle reinforcement section 130 may include a wrap portion 135 together with a support portion 140. The wrap portion 135 may include a carpet foam type material. The support portion 140 may include a shape memory material.

In one embodiment, the wrap portion 135 is a combination of a denser foam 140A and a memory foam 1406. The combination is of the denser foam 140A and memory foam 140B is used in the calf wrap and the tongue portion of the inner boot.

As illustrated, the inside of the heel wrap portion 135 has a denser foam piece that holds down the back of the heel area. The next layer is the memory foam 1356 and behind that is a denser foam butterfly wrap.

Figure 14:
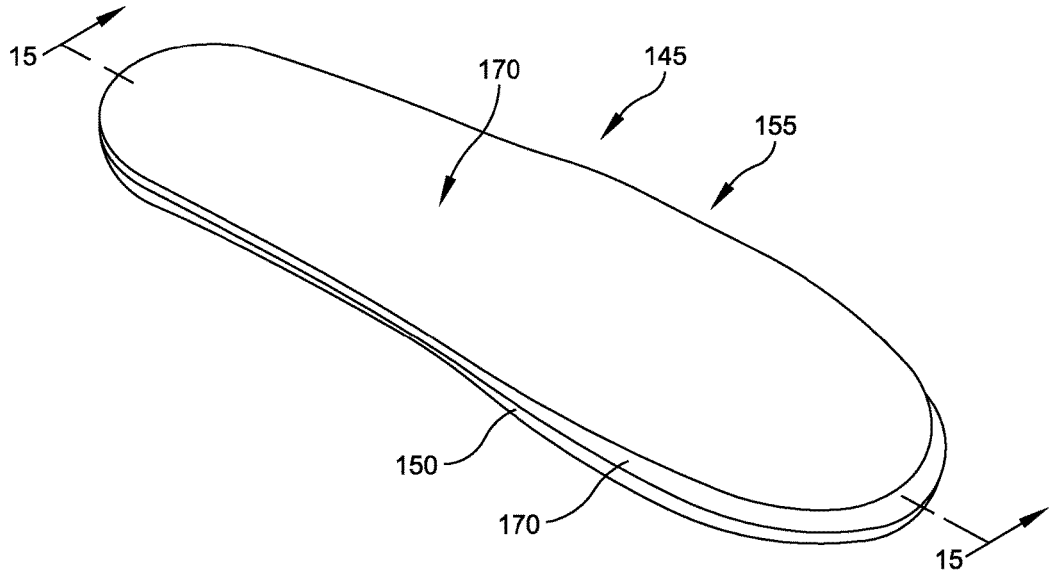
FIG. 14 illustrates a foot bed for use in the inner liner of FIGS. 7-10.
Figure 15:
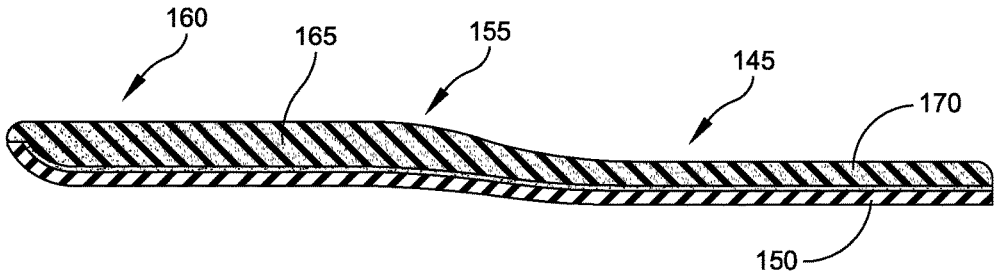
FIG. 15 illustrates a cross-sectional view of the foot bed of FIG. 14.

In an embodiment, and with reference to FIGS. 14 and 15, wherein a foot bed 145 may be provided for disposal within the interior 115 of the liner 15. The foot bed 145 of a ski boot provides the support for the sole of the foot. The foot bed may include a cork portion 150 configured to provide an arch support 155 and a heel cup 160. The greater the surface area of the foot making contact with the foot bed 145 the better the control and performance of the boot. For this reason, many skiers turn to custom moldable foot beds that match the contours of the foot perfectly. However, a custom moldable foot bed does not reconfigure to any changes in a particular individual's foot or to multiple individuals using a single boot. Using a memory foam portion 165 disposed on the cork portion 150, a remolded foot bed is provided with each use of the boot as the memory foam portion 155 molds to the foot at each use. A thin fabric portion 170 disposed on the memory foam portion 165 provides reduced friction when sliding the foot into the inner liner 15 and onto the foot bed 145.

Figure 16:
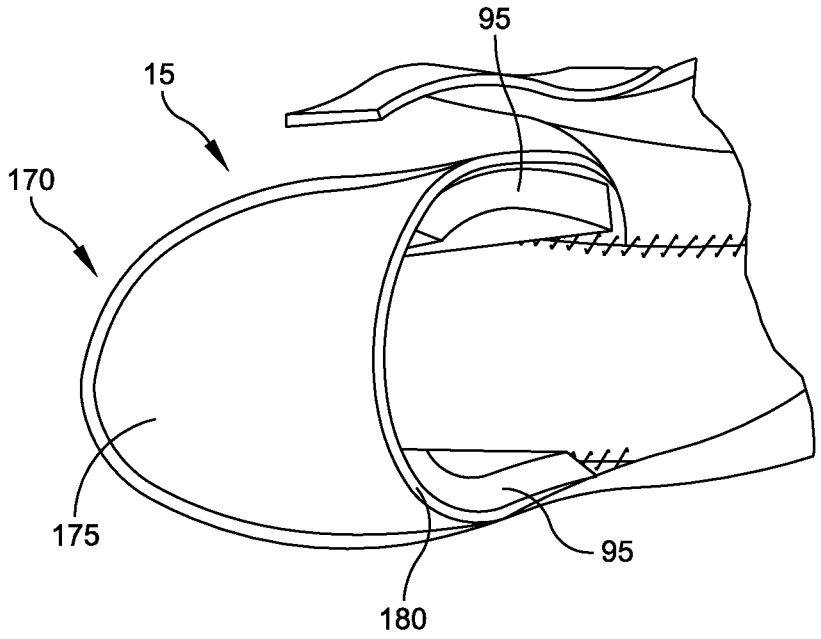
FIG. 16 illustrates a top perspective view of a toe section of the inner liner of FIGS. 7-10.
Figure 17:
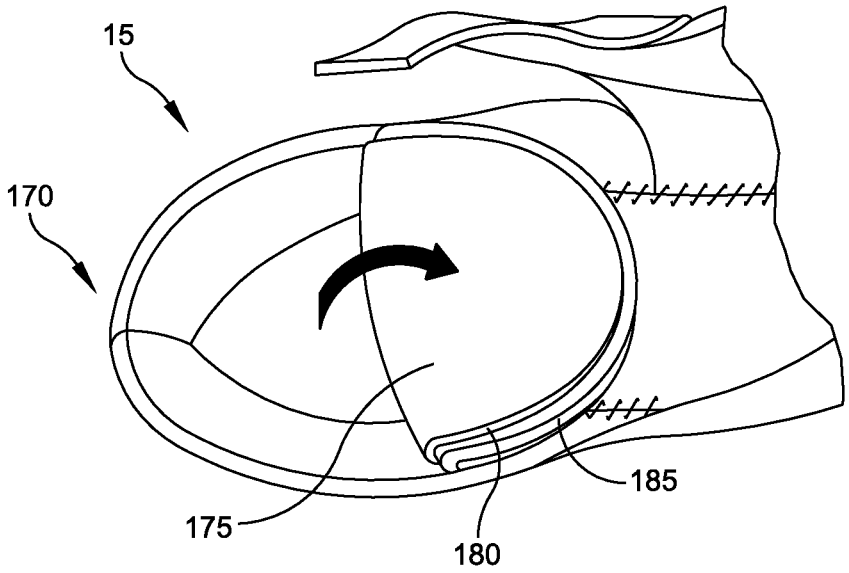
FIG. 17 illustrates a top perspective view of the toe section of FIG. 16, having an expandable piece peeled back.
Figure 18:
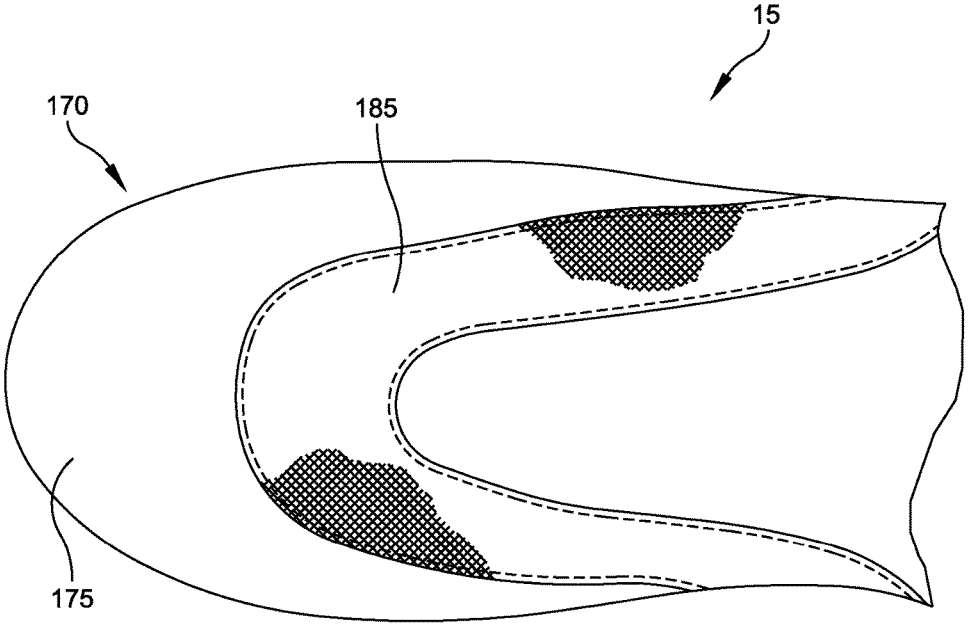
FIG. 18 illustrates a top partial view of an outer surface of the toe and instep sections of the inner liner of FIGS. 7-10.

FIGS. 16-18 illustrates the toe area 170 of liner 15. An expandable piece 175 may be disposed on the outside of the toe area 170. Memory foam wall material 95 lines the toe area 170 and a thin linen piece 180 covers and holds in place memory foam material 95. A reinforcement portion 185 may be disposed on the inner liner 15 in combination with Spandex stretch fabric material, or other suitable stretch fabric material.

In an embodiment, and with reference to FIG. 19, the inner liner 15 contains the skier's foot and is disposed within outer shell 10 in the open configuration 40 prior to either removal of the inner liner 15 worn by the skier from the outer shell 10, 10*a* or closure of the outer shell 10, 10*a* for closing the ski boot to ski.

In various embodiments, ski boot system 5 may include both outer shell 10, 10*a* and inner liner 15, or ski boot system may include only outer shell 10, 10*a* or inner liner 15 apart from the other component.

D. Sizing Inserts

Figure 34:
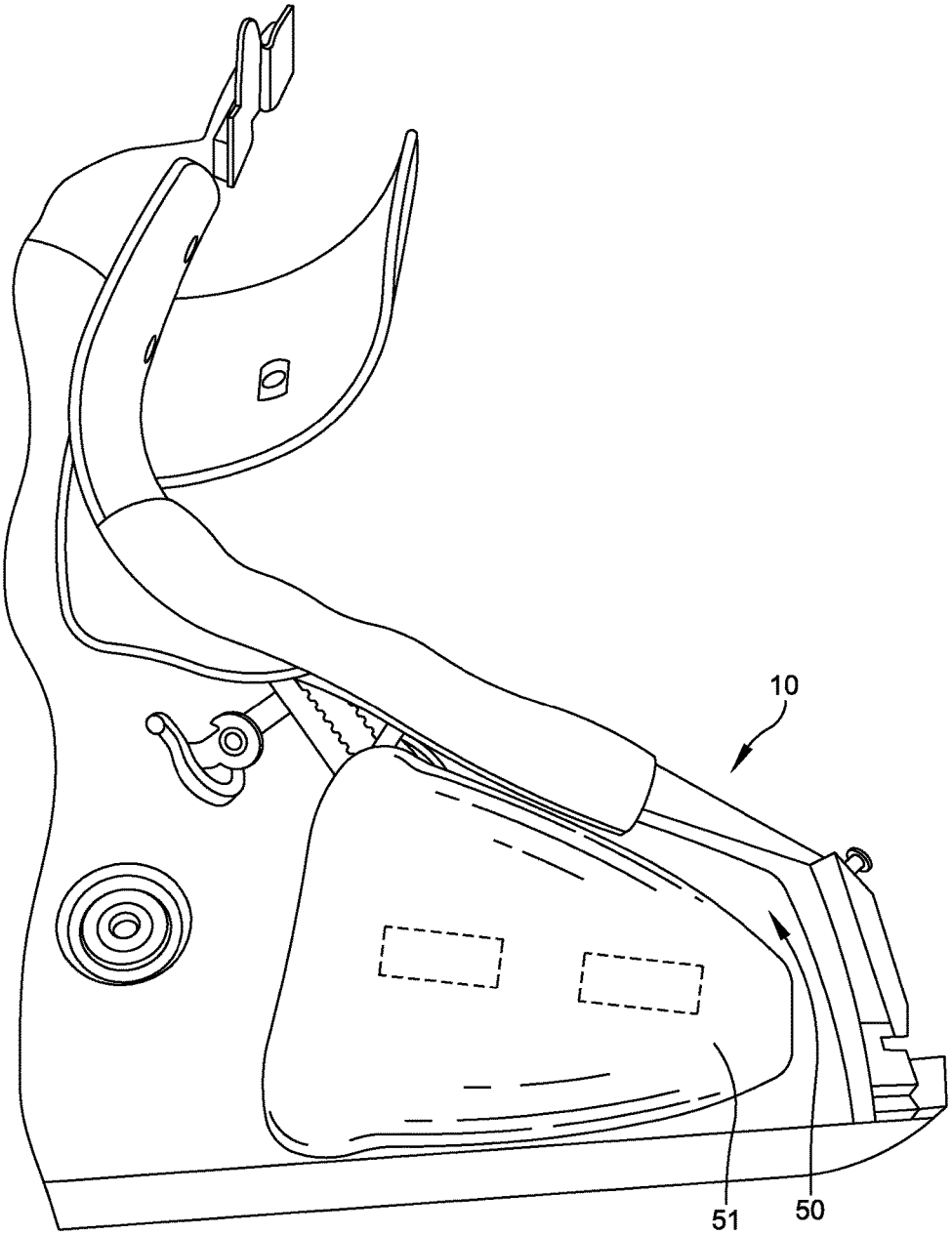
FIG. 34 illustrates a partial cross-sectional view of the outer shell of FIGS. 1 and 4 having one embodiment of a sizing insert disposed within an interior of the shell.

The split-configuration of outer shell 10, 10*a* and the ability to remove liner 15 from outer shell 10, 10*a* both allow for numerous advantages in fit, comfort, performance, and ease of use, as discussed above. The design also allows for flexibility in sizing for the ski boot system. In one embodiment shown in FIGS. 34-36, one or more interchangeable sizing inserts 51 may be employed to modify or re-contour interior 50 of outer shell 10 to accommodate various sizes of inner liner 15. As a result, outer shell 10 may be produced in a generic size large enough to fit a range of widths and lengths of liner 15, each sized to accommodate a different foot size. In turn, inserts 51 may be curved, sized, and/or shaped in a manner that, when attached to interior 50 of outer shell 10, modifies or re-contours the foot bed of interior 50 and allows shell 10 to be customized for each user, or modified as necessary to receive a variety of different sized liners 15 and corresponding foot sizes. Inserts 51 allows shell 10 to accommodate multiple users, which is ideal for a number of applications, including families with multiple skiers and/or in boot-rental scenarios.

Figure 35:
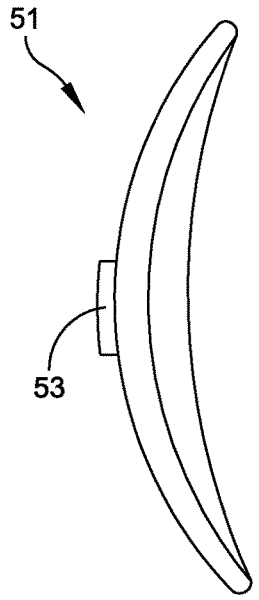
FIG. 35 illustrates a side view of the sizing insert of FIG. 34.
Figure 36:
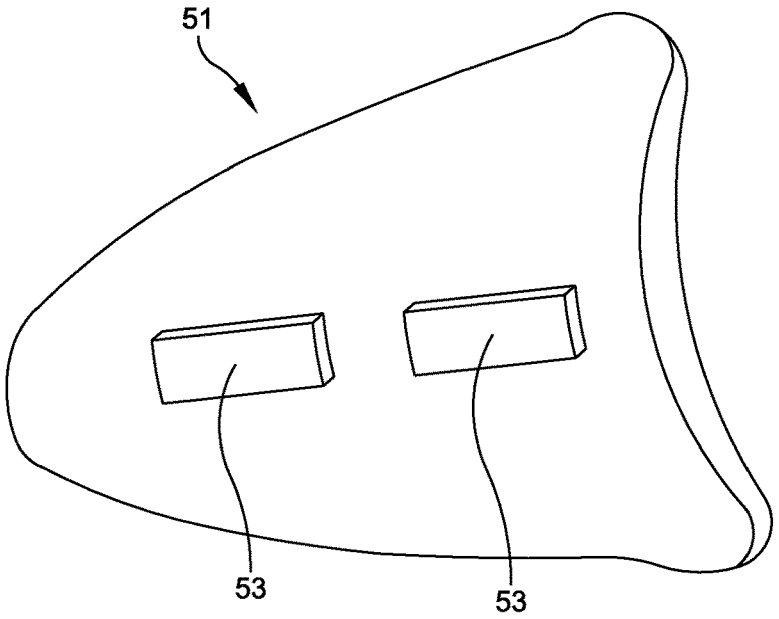
FIG. 36 illustrates a back perspective view of the sizing insert of FIG. 34.

For example, outer shell 10 may be sized to accommodate a men's liner sized nine through twelve. A corresponding series of inserts 51 may be configured to modify the foot bed of the outer shell 10 to individually accommodate liners sized nine, ten, eleven, and twelve. The inserts 51 may be formed of plastic or composite and be designed to snap into a wall of the forefoot of shell 10. Alternatively, and as shown in FIGS. 35-36, inserts 51 may incorporate magnetic portions or strips 53 that engage with mating magnetic portions (not shown) that are built into the foot bed of the shell 10, making it a simple procedure for a user to exchange inserts as necessary. In use, an appropriately sized insert 51 may be disposed (e.g., snapped in or attached via a magnetic connection) along the foot bed of the interior 50 of the shell 10 prior to the skier's insertion of his or her foot, encompassed within a liner. After use, the insert may be removed to ready the outer shell 10 for future customization with a different insert.

Figure 37:
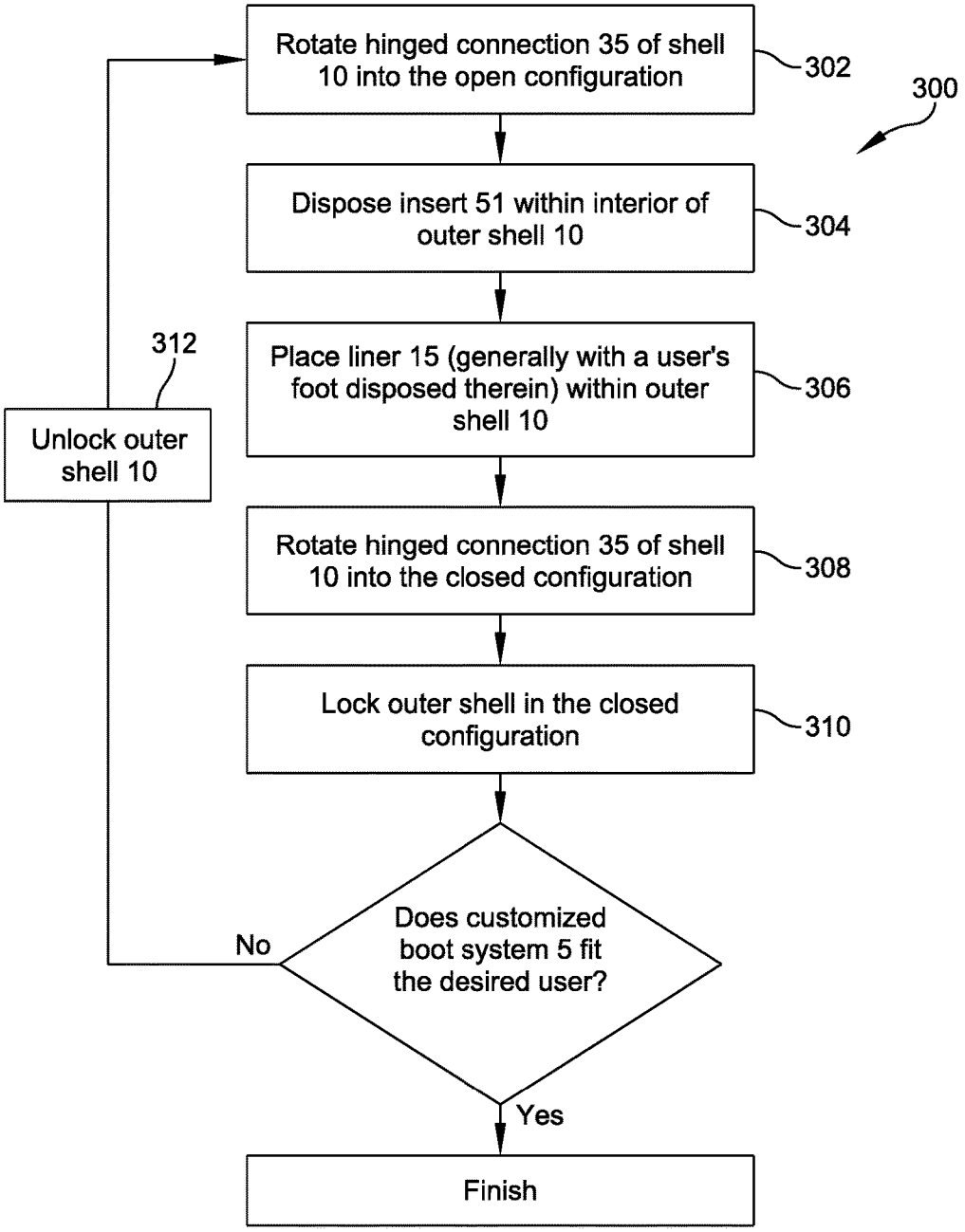
FIG. 37 provides a flow chart detailing an exemplary method of custom fitting the ski boot of FIG. 1.

FIG. 37 illustrates a flow chart detailing an exemplary method 300 for custom fitting ski boot system 5. While method 300 is discussed in relation to ski boot system 5 and outer shell 10, shown in FIGS. 1-4 and 19, it should be understood that the method applies equally to other shell embodiments, including shell 10*a* of FIGS. 26-27.

Method 300 begins with rotating hinged connection 35 of outer shell 10 into open configuration 40 (302) before disposing insert 51 within interior 50 of outer shell 10 (304). Method 300 continues with placing liner 15, generally with a user's foot disposed therein, into outer shell 10 (306), and then rotating hinged connection 35 back into closed configuration 45 (308). Shell 10 may then be fastened or locked into closed configuration 45 (310) in any appropriate manner. At this point, if the fitted ski boot system 5 fits, method 300 may terminate before the user proceeds to use the boot. If ski boot system 5 needs further adjustment or if another user desires to wear ski boot 5, then outer shell 10 may be unlocked (312) and the foot/liner 15 removed before method 300 may be repeated with the same user or a different user until ski boot system 5 is customized to fit as desired.

Although the above embodiments have been described in language that is specific to certain structures, elements, compositions, and methodological steps, it is to be understood that the technology defined in the appended claims is not necessarily limited to the specific structures, elements, compositions and/or steps described. Rather, the specific aspects and steps are described as forms of implementing the claimed technology. Since many embodiments of the technology can be practiced without departing from the spirit and scope of the invention, the invention resides in the claims hereinafter appended.

What is claimed is:

1. An outer shell of a ski boot, the outer shell comprising: a right side portion and a left side portion formed by a longitudinal split through that bisects the outer shell of the ski boot, the right side portion and the left side portion defining the longitudinal split through each of an upper cuff, a lower cuff, and a heel of the outer shell, wherein the upper cuff, the lower cuff, and the heel are separable from one another and disposed in a vertical configuration adjacent to one another, the upper and the lower cuffs coupled via a left side rotating joint and a right side rotating joint; a hinged connection spanning the upper cuff, the lower cuff, and the heel of a rear portion of the outer shell between the right side portion and the left side portion, the hinged connection permitting selective positioning of the outer shell between an open configuration and a closed configuration, the open configuration allowing placement of a first liner into an interior of the shell, and the closed configuration restricting removal of the first liner from the interior of the shell; a tongue rotatively coupled with the lower cuff of the outer shell, the tongue rotatively coupled to rotate between an open position and a closed position, the open position configuring the tongue to one side of the longitudinal split at the lower cuff and the upper cuff of the right side portion and the left side portion of the shell, the closed position configuring the tongue in a transverse placement across the longitudinal split at the lower cuff and the upper cuff of the right side portion and the left side portion of the shell, the open position allowing placement of the first liner into the interior of the shell and the closed position overlapping the longitudinal split at the lower cuff and the upper cuff of the right side portion and the left side portion of the shell in the closed configuration; and a selectively fastenable connector extending between the right side portion and the left side portion, the selectively fastenable connector permitting selective positioning of the outer shell between the open configuration and the closed configuration with only a hand of a user and without an additional tool.

2. The outer shell of claim 1, wherein the selectively fastenable connector comprises at least a first selectively fastenable connector disposed across a forward-facing toe portion of the outer shell and a second selectively fastenable connector extending beneath a bottom portion of the outer shell.

3. The outer shell of claim 2, wherein the first and the second selectively fastenable connectors each comprise a cable buckle.

4. The outer shell of claim 1, wherein the tongue is free of fastening elements.

5. The outer shell of claim 1, wherein the hinged connection includes multiple separate sections, one of the multiple separate sections disposed on the upper cuff, one of the multiple separate sections disposed on the lower cuff, and one of the multiple separate sections disposed on the heel.

6. The outer shell of claim 1, wherein the hinged connection maintains the right side portion and the left side portion in pivotal attachment with one another.

7. The outer shell of claim 1, wherein the selectively fastenable connector is a buckle system, the buckle system including a ladder, a bail, and a latch arm.

8. The outer shell of claim 1, further comprising an insert sized to fit within the interior of the outer shell, wherein the insert is configured to re-contour the interior of the outer shell such that the interior of the outer shell allows placement of a second liner.

9. The outer shell of claim 8, wherein the first liner accommodates a first foot size and the second liner accommodates a second foot size.

10. The outer shell of claim 9, wherein the insert includes a magnetized portion configured to retain the insert within the interior of the outer shell.

11. A ski boot system, comprising: an outer shell and an inner liner, the outer shell comprising: a right side portion and a left side portion formed by a longitudinal split through each of an upper cuff, a lower cuff, and a heel of the outer shell of the ski boot, wherein the upper cuff, the lower cuff, and the heel are separable from one another and disposed in a vertical configuration adjacent to one another; a hinged connection between the right side portion and the left side portion, the hinged connection disposed along a bottom portion of the longitudinally split outer shell and permitting selective positioning of the outer shell between an open configuration and a closed configuration, the open configuration allowing placement of the inner liner into an interior of the outer shell, and the closed configuration restricting removal of the inner liner from the interior of the outer shell; a tongue rotatively coupled with the lower cuff, the tongue rotatively coupled to rotate between an open position and a closed position, the open position configuring the tongue to one side of the longitudinal split at the lower cuff and the upper cuff of the right side portion and the left side portion of the shell, the closed position configuring the tongue in a transverse placement across the longitudinal split at the lower cuff and the upper cuff of the right side portion and the left side portion of the shell; and a locking mechanism disposed along a rear portion of the outer shell and configured to selectively retain the outer shell in the closed configuration, the locking mechanism comprising a joint that couples the upper cuff to the lower cuff, the joint anchored upon the lower cuff of the outer shell.

12. The ski boot system of claim 11, wherein the locking mechanism comprises a toggle locking mechanism, comprising:

a sheath extending across the left side portion and the right side portion of the outer shell; and a toggle disposed upon the sheath, the toggle configured to be received within an aperture formed in the outer shell, wherein when the toggle is disposed within the aperture, the toggle is selectively swivelable between an unlocked position and a locked position that forms the joint that couples the upper and the lower cuffs.

13. The ski boot system of claim 11, wherein the locking mechanism comprises a toggle locking mechanism, comprising:

a toggle disposed upon an outside surface of the outer shell; and a sheath extending across the left side portion and the right side portion of the outer shell, the sheath forming an aperture configured to receive the toggle when the outer shell is in the closed configuration, wherein when the toggle is disposed within the aperture, the toggle is selectively swivelable between an unlocked position and a locked position that forms the joint that couples the upper and the lower cuffs.

14. The ski boot system of claim 11, wherein the locking mechanism comprises a sliding locking mechanism, comprising:

a slider disposed upon an outside surface of the outer shell, wherein the slider is selectively positionable between a retracted position and an extended position; and a sheath extending across the left side portion and the right side portion of the outer shell, wherein the sheath defines an aperture configured to receive the slider when the outer shell is in the closed configuration and the slider is in the retracted position, and wherein once the slider is disposed within the aperture, the slider is selectively positionable to the extended position to form the joint that couples the upper and the lower cuffs.

15. The ski boot system of claim 11, further comprising an insert sized to fit within the interior of the outer shell, wherein the insert is configured to re-contour the interior of the outer shell such that the interior of the outer shell allows placement of an alternate inner liner.

* * * * *